US010030454B2

(12) United States Patent
Heidecke et al.

(10) Patent No.: US 10,030,454 B2
(45) Date of Patent: Jul. 24, 2018

(54) TUBULAR HANDLING TOOL

(71) Applicant: Weatherford Technology Holdings, LLC, Houston, TX (US)

(72) Inventors: Karsten Heidecke, Houston, TX (US); Federico Amezaga, Cypress, TX (US); Scott McIntire, Houston, TX (US); Bjoern Thiemann, Burgwedel (DE); John Fielding Ownby, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/674,848

(22) Filed: Aug. 11, 2017

(65) Prior Publication Data

US 2017/0342783 A1 Nov. 30, 2017

Related U.S. Application Data

(63) Continuation of application No. 14/687,264, filed on May 2, 2014.

(60) Provisional application No. 61/867,924, filed on Aug. 20, 2013, provisional application No. 61/818,871, filed on May 2, 2013.

(51) Int. Cl.
*E21B 19/06* (2006.01)

(52) U.S. Cl.
CPC ..... *E21B 19/06* (2013.01)

(58) Field of Classification Search
CPC ..... E21B 19/06; E21B 19/10
See application file for complete search history.

(56) References Cited

U.S. PATENT DOCUMENTS

| | | | |
|---|---|---|---|
| 4,039,176 | A | 8/1977 | Jansen, Jr. |
| 4,093,281 | A | 6/1978 | Jansen, Jr. |
| 4,650,236 | A | 3/1987 | Haney et al. |
| 5,219,265 | A | 6/1993 | Recker |
| 6,336,508 | B1 | 1/2002 | Guinn |
| 7,296,630 | B2 | 11/2007 | Severin et al. |
| 2010/0006298 | A1 | 1/2010 | Voss et al. |

FOREIGN PATENT DOCUMENTS

| | | | |
|---|---|---|---|
| WO | 91/02138 | A1 | 2/1991 |
| WO | 98/23845 | | 6/1998 |
| WO | 2010081621 | A2 | 7/2010 |

(Continued)

OTHER PUBLICATIONS

International Search Report and Written Opinion, corresponding to PCT/US2014/036641 dated Mar. 9, 2015.

(Continued)

*Primary Examiner* — Michael R Willis, III
(74) *Attorney, Agent, or Firm* — Patterson & Sheridan, L.L.P.

(57) ABSTRACT

Embodiments of the invention generally relate to a tubular handling tool. The tool may include a base and a ring or sleeve member. The tool may further include an actuation member configured to move or rotate the ring or sleeve member relative to the base. Additionally, the tool may include a clamp or dog member attached to the base. The clamp or dog member is configured to move between a radially retracted position and a radially extended position as the ring or sleeve member moves or rotates relative to the base.

20 Claims, 30 Drawing Sheets

(56) References Cited

FOREIGN PATENT DOCUMENTS

| | | | |
|---|---|---|---|
| WO | 2012/119186 | A1 | 9/2012 |
| WO | 2012156751 | A2 | 11/2012 |

OTHER PUBLICATIONS

Australian Examination Report dated Feb. 25, 2016, for Australian Patent Application No. 2014259648.
Australian Examination Report dated Aug. 30, 2016, for Australian Patent Application No. 2014259648.
EPO Office Action dated Jun. 21, 2017, for European Application No. 14733758.8.

TUBULAR HANDLING TOOL

CROSS REFERENCE TO RELATED APPLICATION

This application is a divisional application of U.S. patent application Ser. No. 14/268,764, filed May 2, 2014 and entitled "TUBULAR HANDLING TOOL," which claims benefit of U.S. Provisional Patent Application Ser. No. 61/818,871, filed May 2, 2013, and U.S. Provisional Patent Application Ser. No. 61/867,924, filed Aug. 20, 2013, which applications are herein incorporated by reference in their entirety.

BACKGROUND OF THE INVENTION

Field of the Invention

Embodiments of the invention generally relate to wellbore operations. More particularly, embodiments of the invention relate to a tubular handling tool.

Description of the Related Art

In order to access hydrocarbons from a wellhead on the seafloor, it is necessary to have a riser string that extends from a floating vessel to the wellhead. The riser string is formed by connecting several tubulars together. Therefore, a need exists for an apparatus and a method to position tubulars on the floating vessel in order to form the riser string.

SUMMARY OF THE INVENTION

Embodiments of the invention generally relate to a tubular handling tool. In one aspect, a tool for use with a tubular is provided. The tool includes a base and a ring member. The tool further includes an actuation member configured to move the ring member relative to the base. Additionally, the tool includes a clamp member rotationally attached to the base. The clamp member is configured to move between a radially retracted position and a radially extended position as the ring member moves relative to the base.

In one embodiment, a method of gripping a tubular is provided. The method includes the step of positioning a tool adjacent the tubular. The tool includes a base, a ring member and a clamp member. The method further includes the step of moving the ring member relative to the base. Additionally, the method includes the step of gripping the tubular by moving the clamp member into engagement with the tubular as a result of the movement of the ring member relative to the base.

In one embodiment, a tool for use with a tubular is provided. The tool includes a base, a sleeve member, and an actuation member configured to move the sleeve member relative to the base. The tool further includes a dog member coupled to the base, the dog member configured to move between a radially retracted position and a radially extended position as the sleeve member rotates relative to the base.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a tubular handling tool. The tubular handling tool will be described herein in relation to a tubular that is used in a riser string. It is to be understood, however, that the tubular handling tool may also be used with other tubulars, such as a tubular with flanged tubular connections or tapered tubular (threads) connections. To better understand the novelty of the tubular handling tool and the methods of use thereof, reference is hereafter made to the accompanying drawings.

Figure 1:
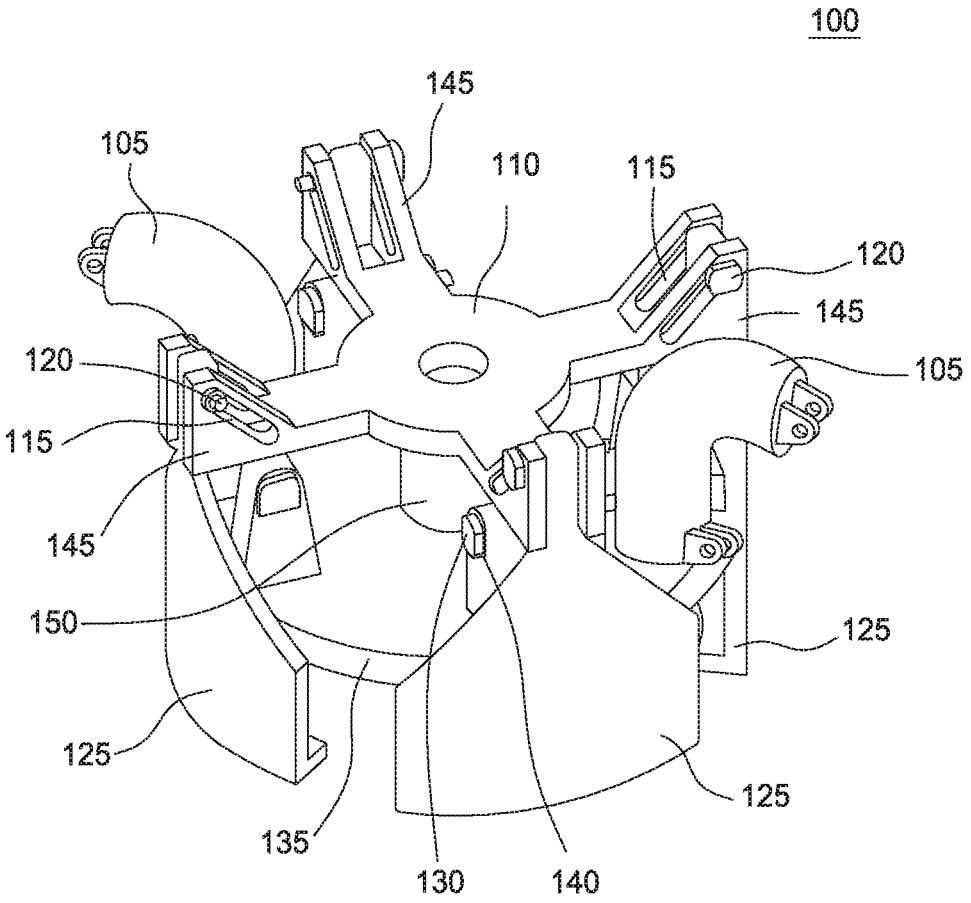
FIG. 1 illustrates a view of a tubular handling tool.

FIG. 1 illustrates a view of a tubular handling tool 100. The tool 100 is configured to engage an upper portion of a tubular. The tool 100 may be used as part of an automated pipe handling system. The tool 100 is configured to move between an open position and a closed position. As will be discussed herein, the rotational movement of the tool 100 may be controlled by an optional rotary actuator.

As shown in FIG. 1, the tool 100 includes a base 135 and a leveling ring 110. The ring 110 is movable relative to the base 135. The ring 110 includes a plurality of couplers 145. Each coupler 145 of the ring 110 includes a slot 115. The tool 100 further includes ears 105 that are configured to attach the tool 100 to a top drive via bails.

An actuation member 150 is disposed between the base 135 and the ring 110. The ring 110 is movable relative to the base 135 as the actuation member 150 moves between an extended position and a retracted position. The actuation member 150 (as well as the other actuation members described herein) may be a hydraulic cylinder, a pneumatic cylinder, a motor or another actuation device known in the art. In one embodiment, the actuation member 150 may include a spring that biases the actuation member 150 in the retracted position to prevent accidental opening of the tool 100 in case of loss of power. As shown in FIG. 1, a single actuation member is used to move the tool 100 between the open position and the closed position. In another embodiment, multiple actuation members may be used to actuate the tool 100.

The tool 100 includes clamp members 125. Each clamp member 125 is pivotally connected to the base 135. In one embodiment, each clamp member is connected to the base 135 via a support member 140 and a pin 130. Each clamp member 125 is also attached to the coupler 145 of the ring 110 via a connection member 120. The clamp member 125 is configured to rotate around the pin 130 as the ring 110 moves relative to the base 135.

Figure 3:
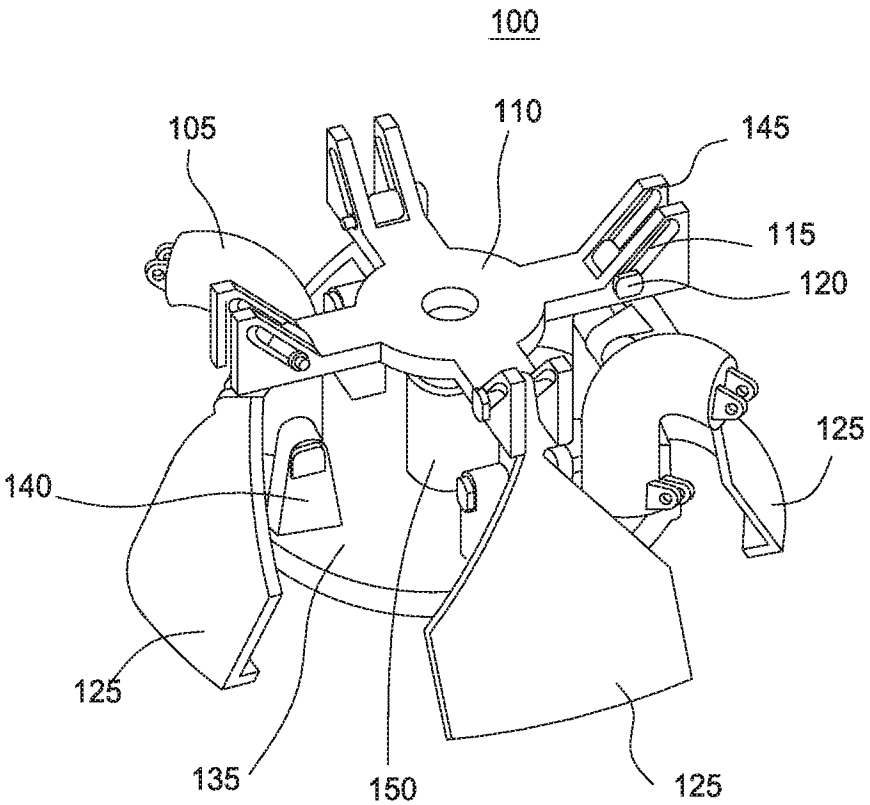
FIG. 3 illustrates a view of the tool in an open position.

The clamp members 125 are movable between a radially retracted position (FIG. 2) and a radially extended position (FIG. 3). The clamp members 125 are in the extended position when the tool 100 is in the open position. The clamp members 125 are in the retracted position when the tool 100 is in closed position. In one embodiment, the clamp members 125 provide 300 degrees of coverage around the tubular. The tool 100 illustrated in FIG. 1 includes four clamp members 125, however there may be any number of clamp members, such as two, three, five, six, seven or eight, without departing from the principles of the present invention. In this manner, the tool 100 may have a multiple number of clamp members to provide variable coverage around the tubular.

Figure 2:
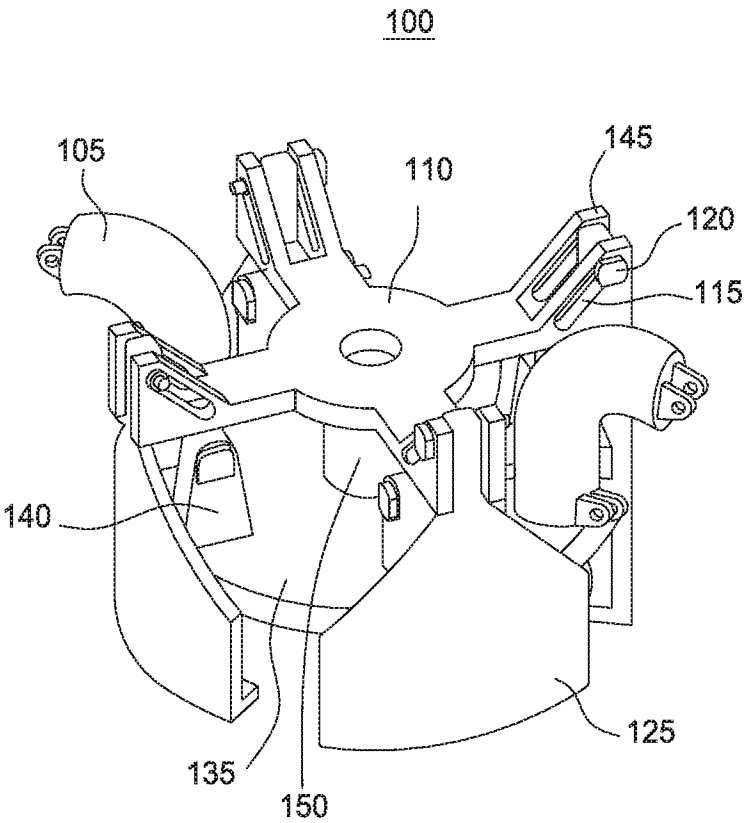
FIG. 2 illustrates a view of the tool in a closed position.

FIG. 2 illustrates a view of the tool 100 in the closed position. As shown in FIG. 2, the actuation member 150 is in the retracted position and the clamp members 125 are in the radially retracted position. In one embodiment, a secondary automated (hydraulic, pneumatic, electronic) or manual locking mechanism, such as locking pins, tabs, fingers, ring, counterbalance valves, etc., may be included in the tool 100 to maintain clamp members 125 in the radially retracted position (i.e., the tool in the closed position).

FIG. 3 illustrates a view of the tool 100 in the open position. As shown in FIG. 3, the actuation member 150 is in the extended position, which causes the ring 110 to move away from the base 135. As the ring 110 moves relative to the base 135, the connection member 120 moves along the slot 115 in the coupler 145 of the ring 110, which results in the clamp member 125 rotating around the pin 130 in the support member 140. In comparing FIG. 2 and FIG. 3, it can be seen that the clamp members 125 move from the radially retracted position to the radially extended position.

Figure 4:
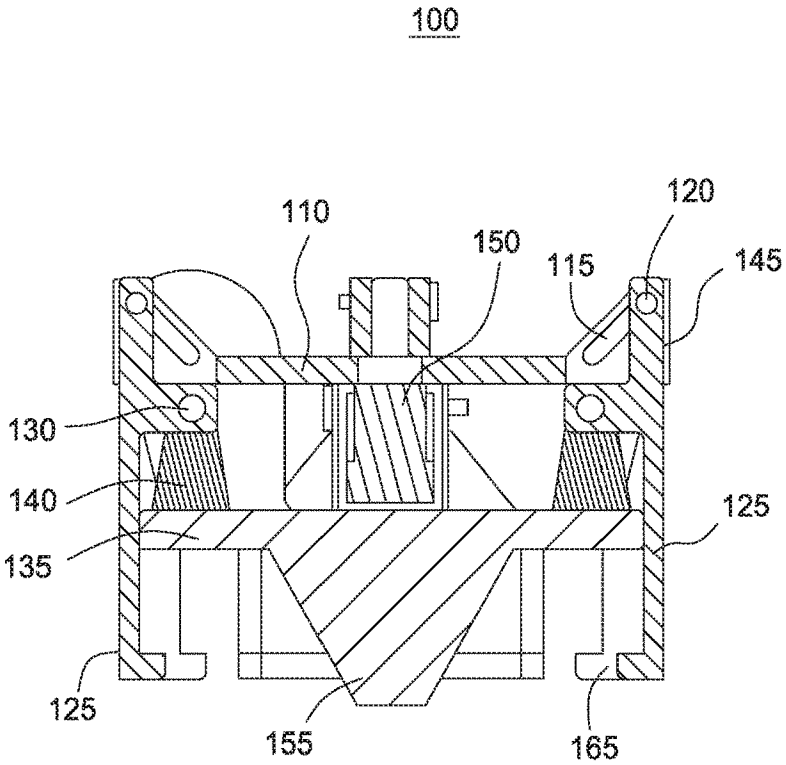
FIG. 4 illustrates a sectional view of the tool in the closed position.

FIG. 4 illustrates a sectional view of the tool 100 in the closed position. As shown in FIG. 4, the clamp members 125 are in the radial retracted position. As also shown in FIG. 4, each clamp member 125 includes a grip portion 165 that is configured to engage a portion of the tubular. The grip portion 165 of the clamp member 125 may be designed based upon the type of tubular handled by the tool 100. Specifically, the grip portion 165 shown in FIG. 4 is configured to engage a flange of a tubular that is used in a riser string (see FIG. 6). In another embodiment, the grip portion 165 may have a different profile when the tool 100 is used with a tubular that has flanged tubular connections or tapered tubular (threads) connections.

Figure 5:
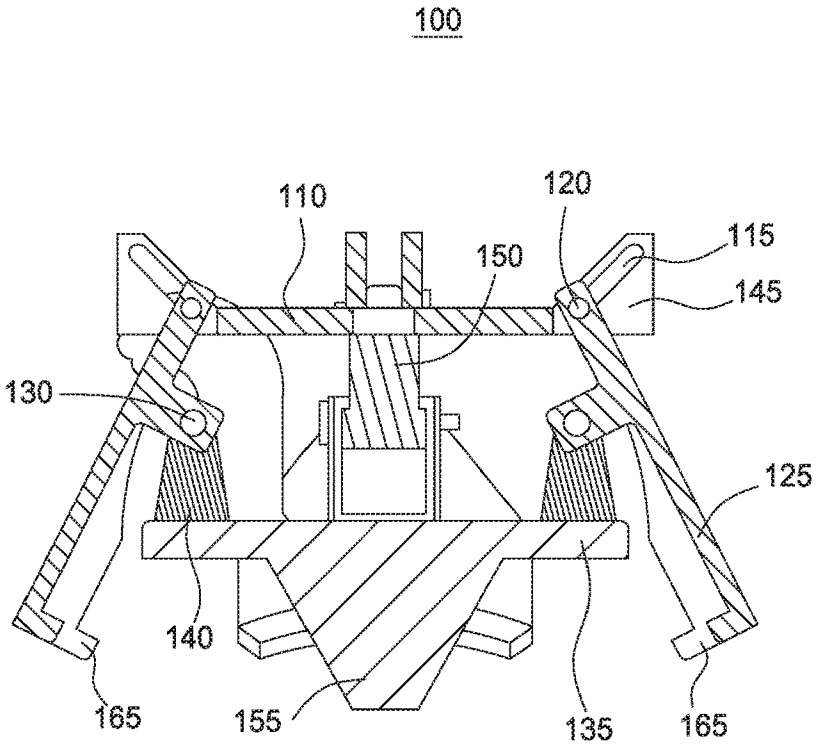
FIG. 5 illustrates a sectional view of the tool in the open position.

FIG. 5 illustrates a sectional view of the tool 100 in the open position. As shown in FIG. 5, the ring 110 has moved away from the base 135 due to the actuation member 150 being moved to the extended position. In addition, each clamp member 125 has rotated around the pin 130 in the support member 140 as the ring 110 moves relative to the base 135. As also shown in FIG. 5, the base 135 includes a guide member 155. The guide member 155 is configured to position or centralize the tool 100 around the tubular when the tool 100 engages the tubular.

Figure 6:
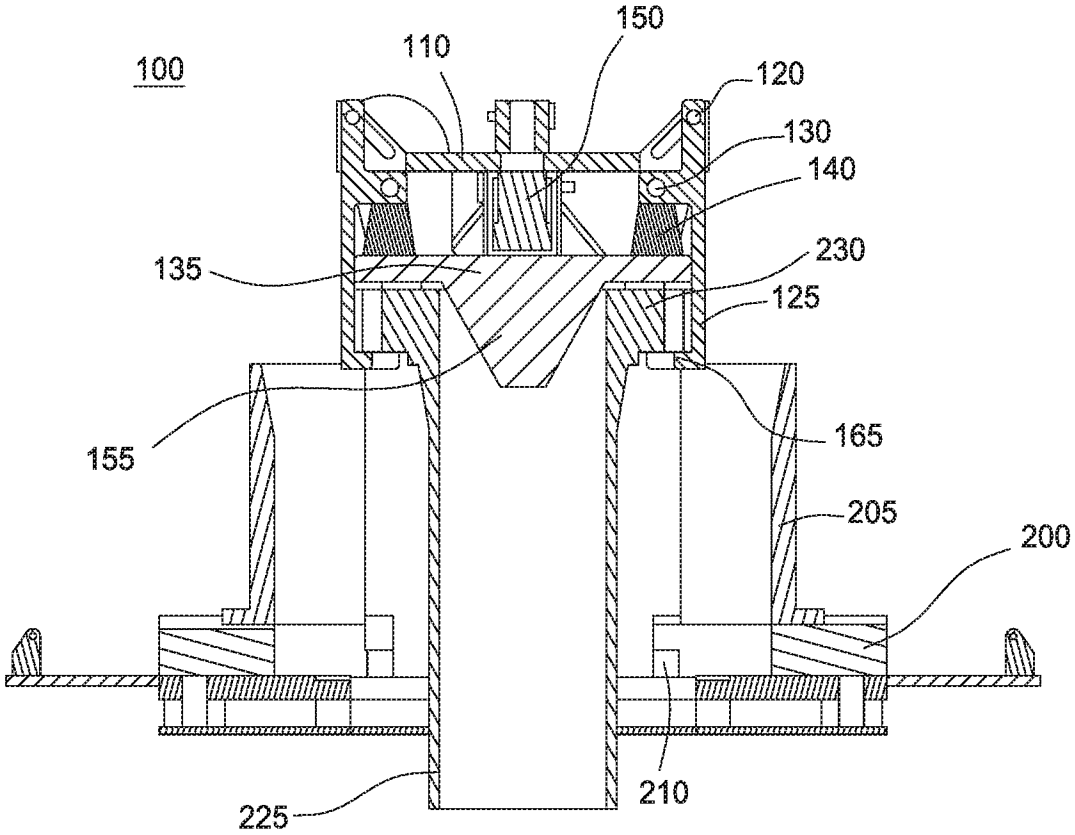
FIG. 6 illustrates a view of the tool engaged with a tubular.

FIG. 6 illustrates a view of the tool 100 engaged with a tubular 225. As shown, the tool 100 is in the closed position. As also shown, the clamp members 125 are in the radially retracted position such that the grip portion 165 of each clamp member 125 supports a flange 230 of the tubular 225.

The tool 100 may be part of a pipe handling system that is used to pick up the tubular 225 from a V-door or a pipe ramp on a rig floor. The system may include a link-tilt device. The link-tilt device may be used to pivot the link arms out and back as required e.g. by use of an appropriate piston-cylinder arrangement. The tool 100 is connected to the link-tilt device. The system may include a support 205 (e.g., neck) that is attached to a sliding table 200. The support 205 is configured to hold the tubular 225.

In one embodiment, an Integrated Safety Interlock System (ISIS) connected with the sliding table 200 may be included in the tool 100 to prevent accidental opening. More specifically, the interlock system can be installed on the sliding table 200 and the tool 100 to prevent dropped pipe string situations. Sensors may be added to the tool 100 to determine the position of the clamp members 125. The sensors may be attached to actuation member 150 and/or the clamp members 125. The sensors on the actuation member 150 may be used to determine if the actuation member 150 is in the extended position or the retracted position. The sensors on the clamp members 125 may be used to determine if the clamp members 125 are in the radially retracted position or the radially extended position. Also, positional interlocks could be in place to prevent unwanted motion between the top drive and other components in the pipe handling system. A control system could be incorporated into a panel which is operated by a single person. Additionally, communication may be maintained with other people at the well site either through an indicator box, mechanical and/or electrical interlocks, verbal/visual cues, or the entire system could be operated from a console, if desired.

Figure 7:
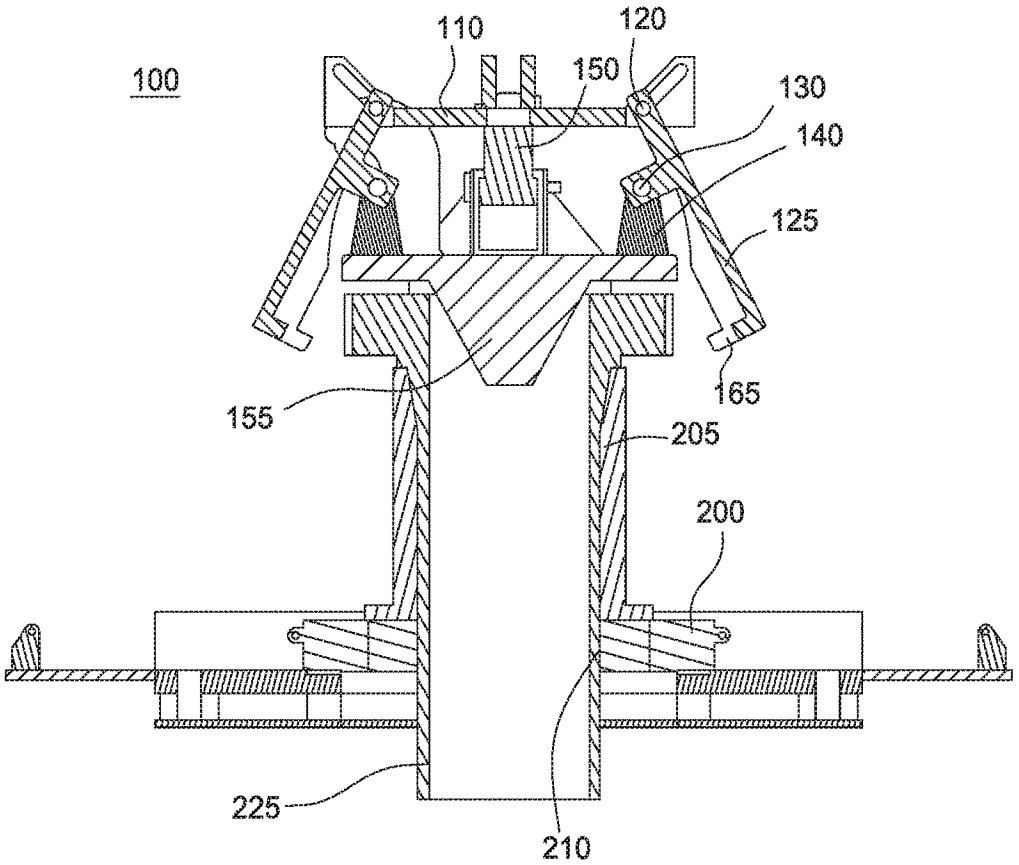
FIG. 7 illustrates a view of the tool released from the tubular.

In the operation of the pipe handling system, the tool 100 is lowered toward the rig floor and positioned adjacent a tubular by operating the link-tilt device. The tool 100 is moved to the open position (FIG. 3) as described herein. The guide 155 is used to center the tool 100 around the tubular and then the tool 100 is moved to the closed position (FIG. 2) as described herein. At this point, the tool 100 can support the weight of the tubular. In one embodiment, the tool 100 may have a 500 ton capacity. The tool 100 and the tubular 225 are raised using the components in the pipe handling system. Thereafter, the tubular is lowered through an opening 210 of the table 200 until the flange 230 of the tubular 225 is positioned adjacent the support 205 as shown in FIG. 6. The table 200 is closed around the tubular 225, which causes the support 205 to engage the tubular 225 as shown in FIG. 7. Next, the tool 100 is moved to the open position and releases the tubular 225. In one embodiment, ISIS prevents the tool 100 from opening unless the table 200 is closed. The tubular 225 is connected to the riser string and the tool 100 may be used to pick up another tubular from the rig floor. The process of picking up a tubular and connecting the tubular to riser string is repeated until the riser string is completed. The process can be automated through the use of a joystick or another remote control device. For instance, the tool 100 may be moved between the open and closed position by using the joystick to control the actuation member 150. The link-tilt device and other components in the pipe handling system may also be controlled using the joystick. In this manner, the tool 100 and other components in the pipe handling system may be automated.

Figure 8:
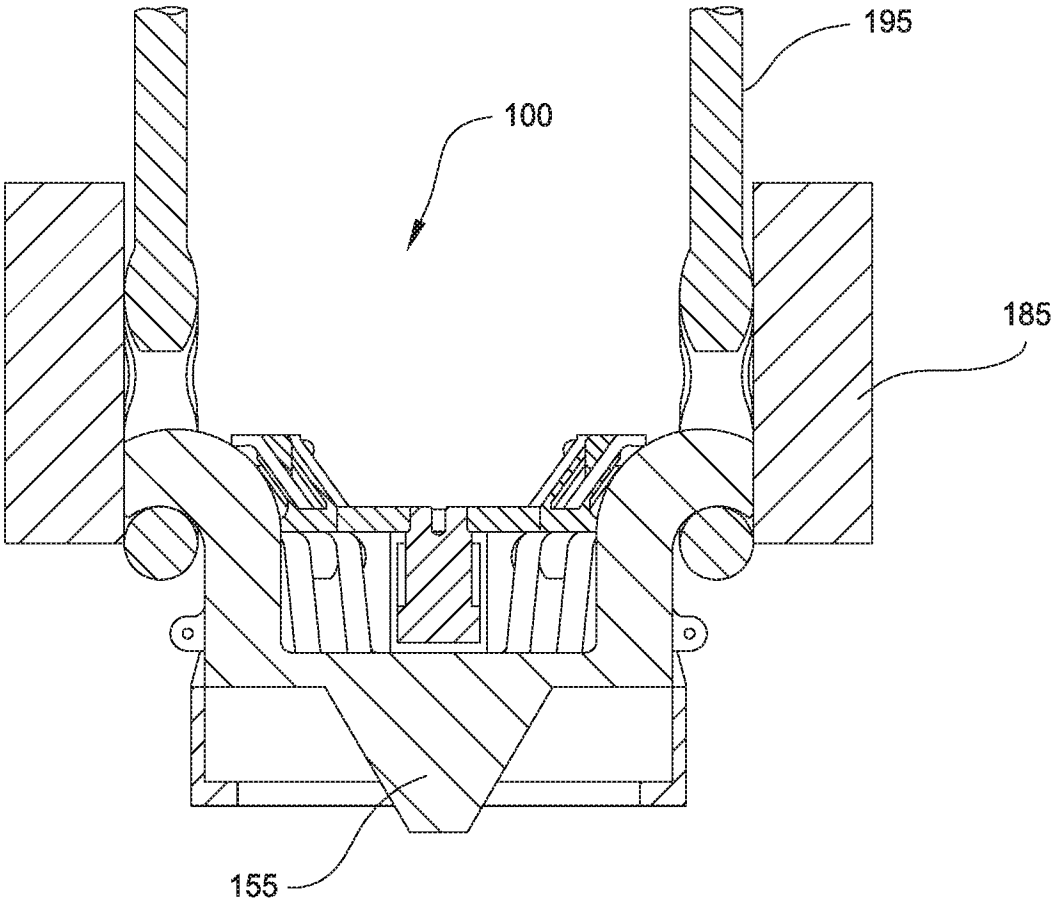
FIG. 8 illustrates a view of the tool with a rotary actuator.

FIG. 8 illustrates a view of the tool 100 with an optional rotary actuator 185. The rotary actuator 185 is configured to rotate the tool 100. Specifically, the rotary actuator 185 is configured to tilt the tool 100 at an angle relative to bails 195. The bails 195 are used to connect the tool 100 to a top drive in the pipe handling system. The ability to tilt the tool 100 is useful when the tool 100 is used to pick up a tubular from the V-door when the tubular is at a specific angle. The rotary actuator 185 may be used with the other components in the pipe handling system. Additionally, the rotary actuator 185 may be controlled by the joystick or the remote control device.

Figure 9:
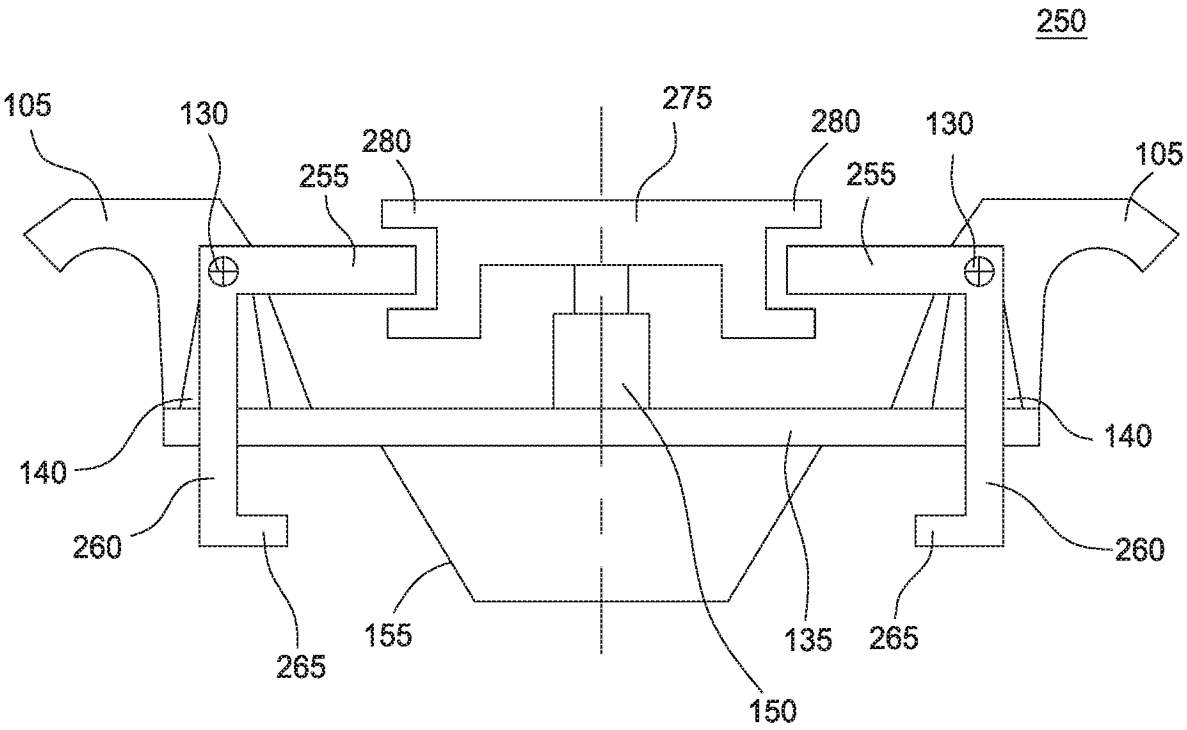
FIG. 9 illustrates a view of a tubular handling tool.

FIG. 9 illustrates a view of another embodiment of a tubular handling tool 250. For convenience, the components in the tool 250 that are similar to the components in the tool 100 will be labeled with the same number indicator. The tool 250 includes the base 135 and a leveling ring 275. The tool 250 further includes the actuation member 150 that is configured to move the ring 275 relative to the base 135. The ring 275 includes a plurality of couplers 280.

The tool 250 includes clamp members 260. Each clamp member 260 is connected to the base 135 via the support member 140 and the pin 130. Each clamp member 260 includes an end 255 that is configured to interact with a coupler 280 of the ring 275. The clamp member 260 is configured to rotate around the pin 130 as the ring 265 moves relative to the base 135. The clamp member 260 also includes a grip portion 265 that is configured to engage a portion of the tubular. The grip portion 265 of the clamp member 260 may be selected based upon the type of tubular handled by the tool 250. Specifically, the grip portion 265 shown in FIG. 9 is configured to engage a flange of a tubular that is used in a riser string. In another embodiment, the grip portion 265 may have a different profile when the tool 250 is used with a tubular that has a tapered flange or a straight flange. The clamp members 260 are movable between a radially retracted position and a radially extended position. The clamp members 260 are in the radially extended position when the tool 250 is in the open position and the clamp members 260 are in the radially retracted position when the tool 250 is in closed position. The tool 250 may have any number of clamp members 260 without departing from the principles of the present invention.

The tool 250 is shown in FIG. 9 in the closed position. The actuation member 150 is in the extended position and the clamp members 260 are in the radially retracted position. To move the tool 250 to the open position, the actuation member 150 is moved to the retracted position, which causes the ring 275 to move toward the base 135. As the ring 275 moves towards the base 135, the coupler 280 of the ring 275 acts on the end 255 of each clamp member 260, which results in the clamp member 260 rotating around the pin 130 in the support member 140 to the radially extended position. To move the tool 250 to the closed position, the actuation member 150 is moved to the extended position, which causes the ring 275 to move away from the base 135. As the ring 275 moves away from the base 135, the coupler 280 of the ring 275 acts on the end 255 of each clamp member 260, which results in the clamp member 125 rotating around the pin 130 in the support member 140 to the radially retracted position.

FIGS. 10A, 10B, 11A, and 11B illustrate a tubular handling tool 300, which operates in a similar manner as the tool 100. The embodiments of the tool 300 may be used with the embodiments of the other tools described herein, and vice versa. The components in the tool 300 that are similar to the components in the tool 100 are labeled with the same reference numeral but with a 300 series designation.

The tool 300 includes ears 305, a guide member 355, a base 335, a leveling ring 310, and an actuation member 350 that is configured to move the ring 310 relative to the base 335. The base 335 (and any other base members described herein) may include any type of frame or structure configured to support one or more components of the tool 300. The actuation member 350 (and any other actuation members described herein) may include one or more hydraulic, pneumatic, and/or electric motors, valves, and/or piston-cylinders known in the art for moving the ring 310. The actuation member 350 (and any other actuation members described herein) may be spring loaded or otherwise biased into a failsafe close position, in the event of a loss of power to prevent inadvertent opening of the tool 300 when supporting a tubular. Secondary automated or manual locking mechanisms, such as locking pins, tabs, fingers, rings, valves, etc. may be used to lock the tool 300 (and any other tools described herein) in the open and/or closed position.

The tool 300 further includes a plurality of guide pins 317 supported by the base 335 and coupled to the ring 310. The pins 317 are configured to guide and maintain the ring 310 in a substantially level position as the ring 310 is moved upward and downward relative to the base 335. The pins 317 may extend out of and retract into cylinder housings as the ring 310 is raised and lowered relative to the base 335.

The tool 300 further includes a plurality of clamp members 325. The ring 310 includes a plurality of couplers 345 for connection to the clamp members 325, the couplers 345 each having a slot 315 that includes a vertical slot section and an angled slot section. Each clamp member 325 is connected to the base 335 via a support member 340 and a pin 330. Each clamp member 325 is connected to the coupler 345 by a connection member 320 that is moveable within the slot 315 formed in the coupler 345. The clamp member 325 is configured to rotate around the pin 330 as the ring 310 moves relative to the base 335. The clamp member 325 also includes a grip portion 365 that is configured to engage a portion of a tubular, such as a riser string flange.

The clamp members 325 are movable between a radially retracted position and a radially extended position. The clamp members 325 are in the radially extended position when the tool 300 is in the open position. The clamp members 325 are in the radially retracted position when the tool 300 is in closed position. The tool 300 may have any number of clamp members 325.

Figure 10B:
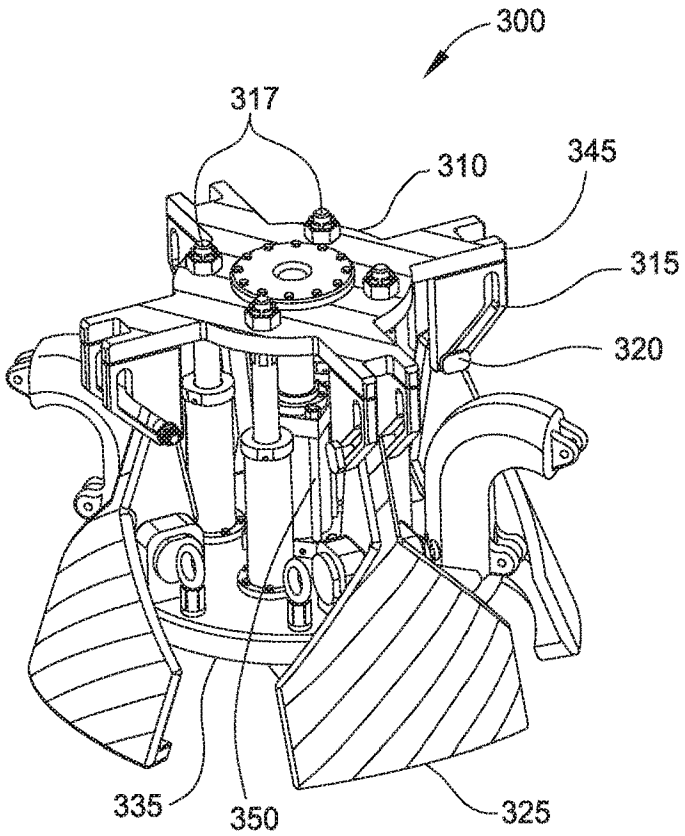
FIGS. 10A, 11A and 10B, 11B illustrate a tubular handling tool in open and closed positions, respectively.
Figure 10A:
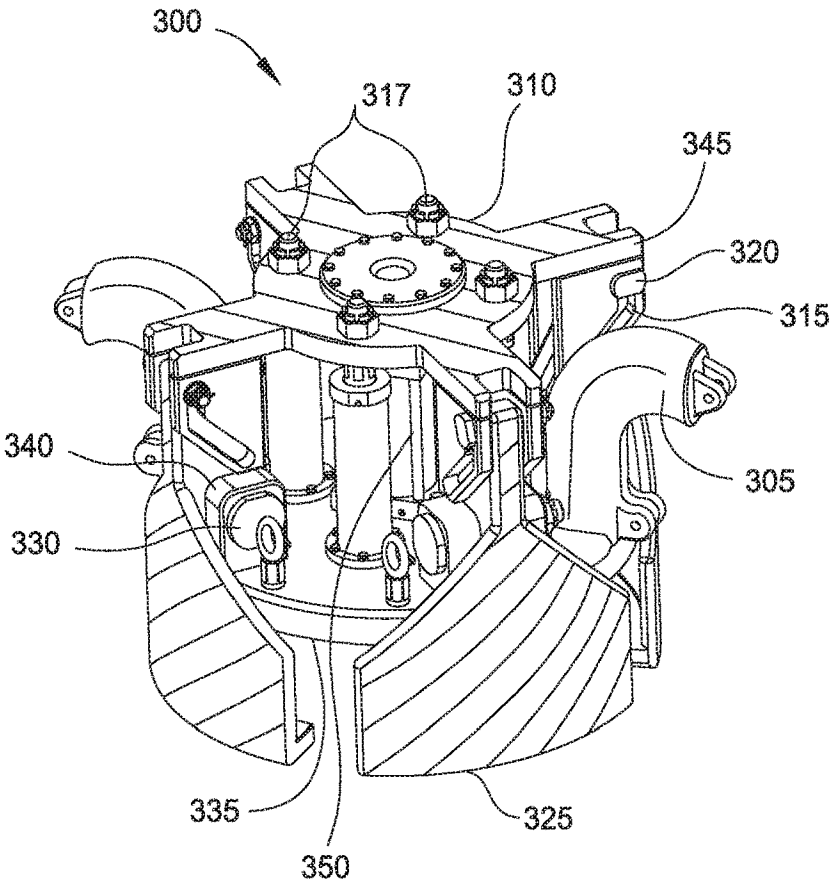
Figure 11B:
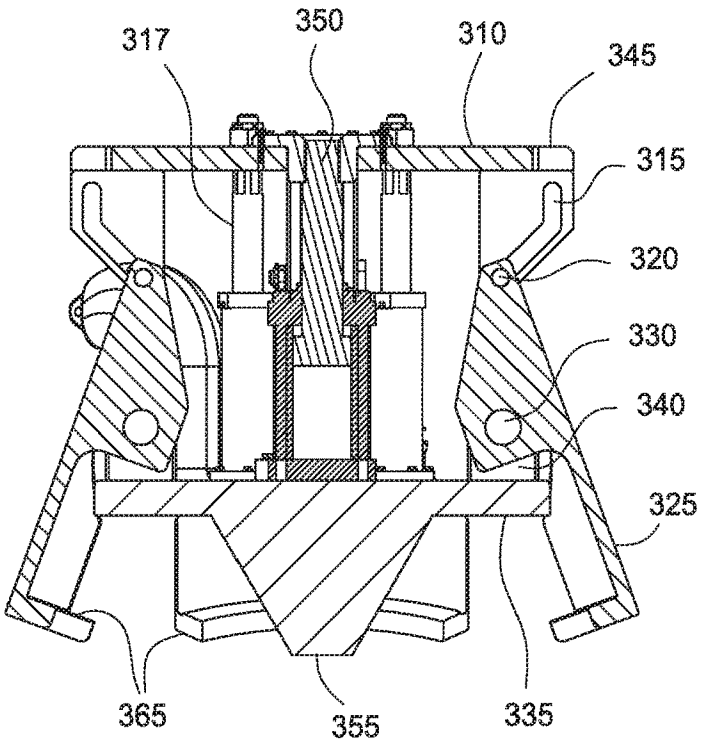
Figure 11A:
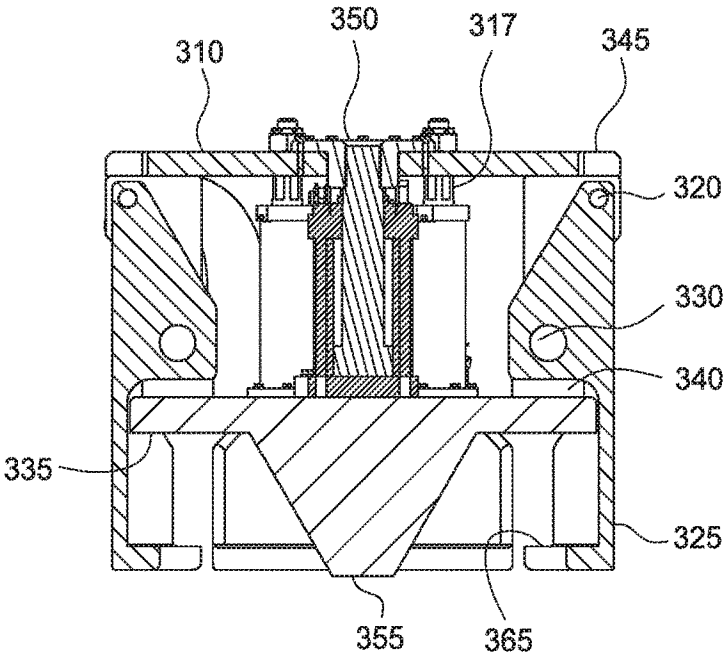

The tool 300 is shown in FIGS. 10A and 11A in the closed position, and is shown in FIGS. 10B and 11B in the open position. When in the closed position, the actuation member 350 is in the retracted position, and the clamp members 325 are in the radially retracted position. Also, the connection member 320 is positioned within the vertical section of the slot 315 to avoid transferring any load to the coupler 345 that may inadvertently move the tool 300 to the open position when supporting a tubular.

To move the tool 300 to the open position, the actuation member 350 is moved to the extended position, which moves the ring 310 away from the base 335. As the ring 310 moves away from the base 335, the connection member 320 moves along the angled section of the slot 315 in the coupler 345, thereby rotating the clamp member 325 around the pin 330 to the radially extended position. To move the tool 300 back to the closed position, the actuation member 350 is moved to the retracted position, which moves the ring 310 toward the base 335. As the ring 310 moves toward the base 335, the connection member 320 moves along angled section of the slot 315 (and then into the vertical section of the slot 315) in the coupler 345, thereby rotating the clamp member 325 around the pin 330 to the radially retracted position.

Figures 12A, 12B, 12C:
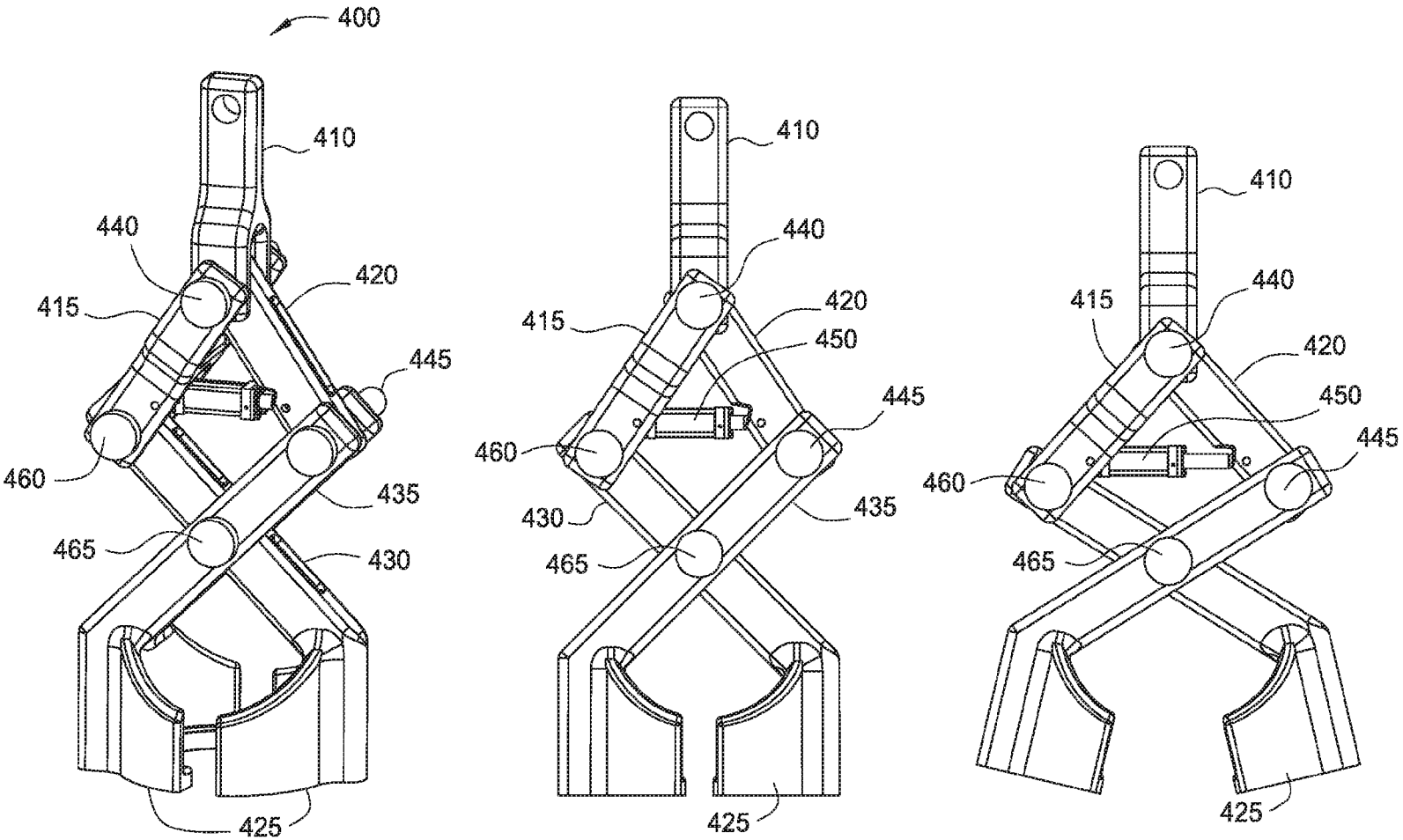
FIGS. 12A, 12B, and 12C illustrate a tubular handling tool.

FIGS. 12A, 12B, and 12C illustrate a tubular handling tool 400. The embodiments of the tool 400 may be used with the embodiments of the other tools described herein, and vice versa. The tool 400 may include a support member 410 and arms 415, 420 that are pivotably connected to the support member 410 via a connection member 440. The tool 400 may further include clamp members 425 having arms 430, 435 that are pivotably connected, respectively, to one of the arms 415, 420 via connection members 460, 445. The arms 430, 435 of the clamp members 425 may also be pivotably connected to each other via a connection member 465. The tool 400 may further include an actuation member 450, such as a piston/cylinder or motor, coupled at opposite ends to the arms 415, 420.

The tool 400 is shown in FIGS. 12A and 12B in the closed position, and is shown in FIG. 12C in the open position. When in the closed position, the actuation member 450 is in the retracted position, and the clamp members 425 are in the radially retracted position for engagement with a tubular. To move the tool 400 to the open position, the actuation member 450 is moved to the extended position, which forces the arms 415, 420 to pivot away from each other about the connection member 440, thereby causing the upper ends of the arms 430, 435 of the clamp members 425 (via connection members 445, 460) to pivot away from each other about the connection member 465. As the upper ends of the arms 430, 435 pivot away from each other about the connection member 465, the clamp members 425 at the opposite ends also move away from each other into the radially extended position.

To move the tool 400 back to the closed position, the actuation member 450 is moved to the retracted position, which forces the arms 415, 420 to pivot toward each other about the connection member 440, thereby causing the upper ends of the arms 430, 435 of the clamp members 425 (via connection members 445, 460) to pivot toward each other about the connection member 465. As the upper ends of the arms 430, 435 pivot toward each other about the connection member 465, the clamp members 425 at the opposite ends also move toward each other into the radially retracted position.

The support member 410 may be used to connect the tool 400 to a top drive system or other tubular handling system, such as by bails. The tool 400 may include a rotary actuator, such as rotary actuator 185, to tilt and pivot the tool 400 to engage a tubular that is positioned at an angle, such as a tubular positioned in a V-door. When supporting a load, the clamp members 425 are drawn toward each other about the connection member 465 into the closed position as a failsafe mechanism. Thus, in the event of a loss of power, the tool 400 is configured to remain in the closed position to prevent inadvertent release of a tubular that is being supported by the clamp members 425.

FIGS. 13A, 13B, 14A, and 14B illustrate a tubular handling tool 500, which operates in a similar manner as the tool 100. The embodiments of the tool 500 may be used with the embodiments of the other tools described herein, and vice versa. The components in the tool 500 that are similar to the components in the tools 100, 300 are labeled with the same reference numeral but with a 500 series designation.

The tool 500 includes ears 505, a guide member 555, a base 535, a leveling ring 510, and an actuation member 550 that is configured to move the ring 510 relative to the base 535. The tool 500 includes a plurality of guide pins 517 supported by the base 535 and coupled to the ring 510. The pins 517 are configured to guide and maintain the ring 510 in a substantially level position as the ring 510 is moved upward and downward relative to the base 535. The ring 510 includes a plurality of couplers 545.

The tool 500 further includes a sleeve member 570 that is connected to the couplers 545 of the ring 510 via a support member 515 and a connection member 520. The sleeve member 570 may be disposed entirely or partially about the circumference of the base 535. The tool 500 further includes a plurality of dogs 575 that are supported within one or more openings 572 formed in the sleeve member 570 by backing members 573. The dogs 575 are also supported within one or more openings 537 formed in the base 535. The dogs 575 are movable radially inward by the sleeve member 570, and are biased radially outward by one or more biasing members, such as springs, disposed between the base 535 and the dogs 575.

The dogs 575 are movable between a radially retracted (inward) position and a radially extended (outward) position. The dogs 575 are in the radially extended position when the tool 500 is in the open position, and the dogs 575 are in the radially retracted position when the tool 500 is in closed position. The tool 500 may have any number of dogs 575 that are configured to engage a portion of the tubular 225, such as a riser string flange.

Figure 13B:
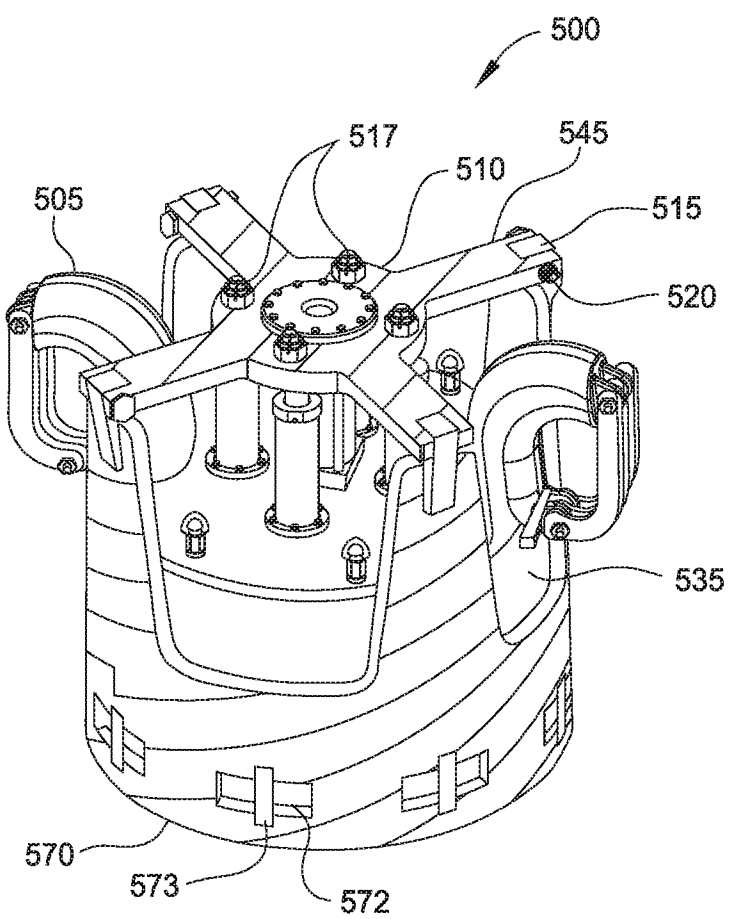
FIGS. 13A, 14A and 13B, 14B illustrate a tubular handling tool in open and closed positions, respectively.
Figure 13A:
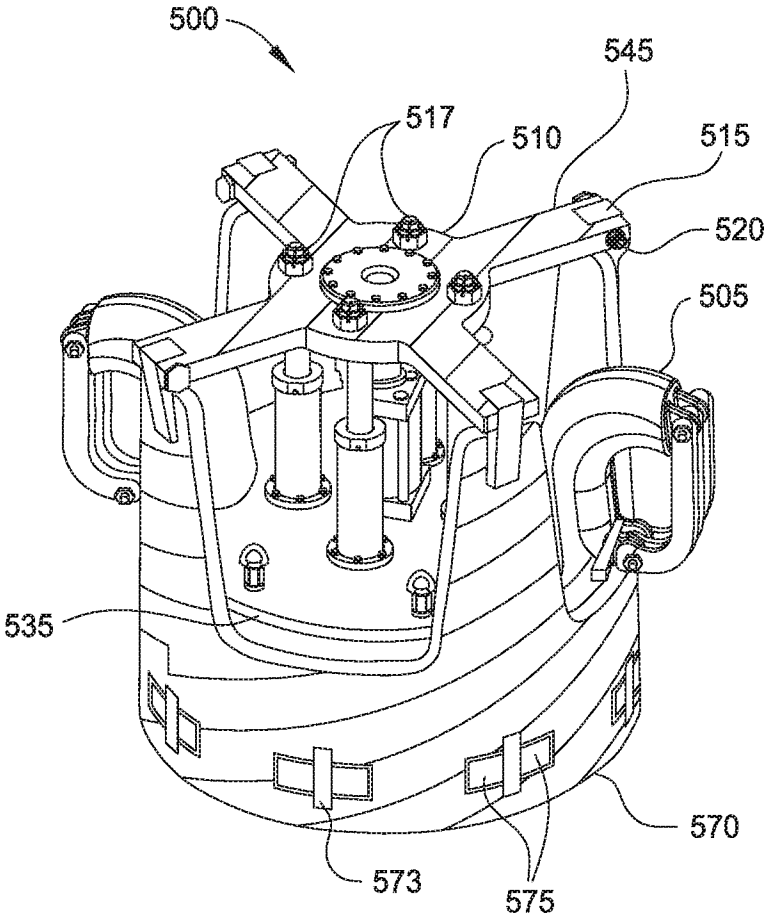
Figure 14B:
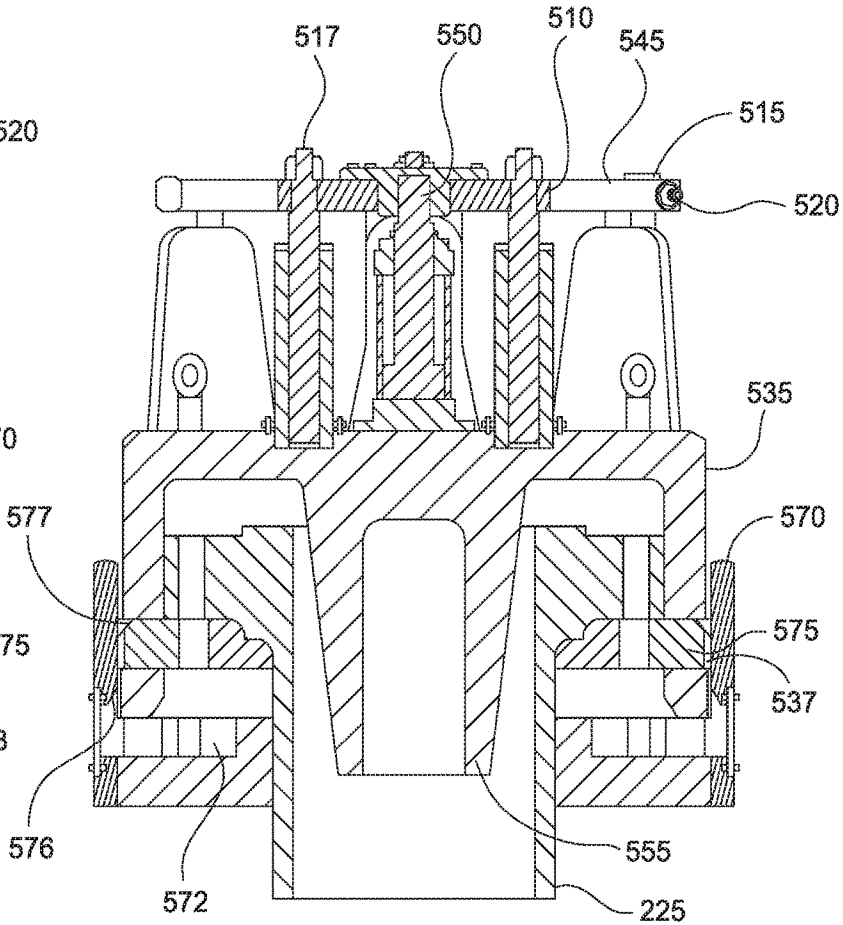
Figure 14A:
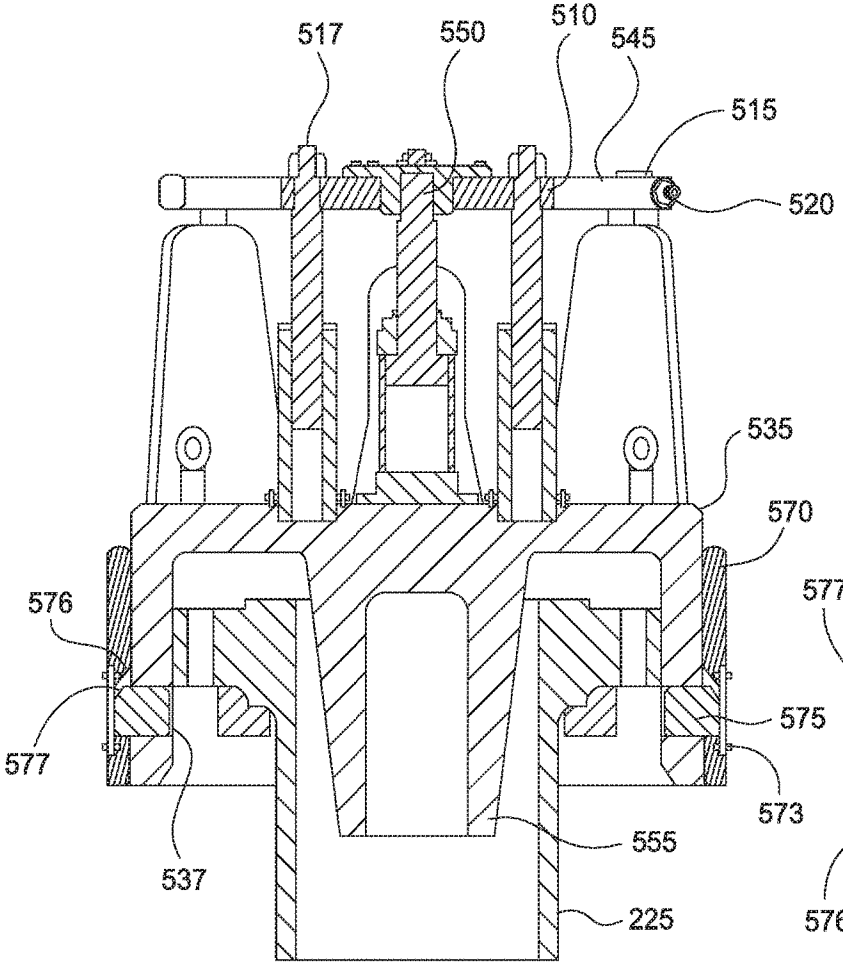

The tool 500 is shown in FIGS. 13A and 14A in the open position, and is shown in FIGS. 13B and 14B in the closed position. When in the open position, the actuation member 550 is in the extended position, and the dogs 575 are biased in the radially extended (outward) position. To move the tool 500 to the closed position, the actuation member 550 is moved to the retracted position, which moves the ring 510 toward the base 535. As the ring 510 moves toward the base 535, the sleeve member 570 is lowered such that a tapered surface 576 of the sleeve member 570 moves into engagement with a tapered surface 577 of the dogs 575 to force the dogs 575 radially inward into the retracted position. The openings 572 of the sleeve member 570 are moved below the dogs 575, such that the inner surface of the sleeve member 570 maintains the dogs 575 in the radially retracted (inward) position.

To move the tool 500 back to the open position, the actuation member 550 is moved to the extended position, which moves the ring 510 away from the base 535. As the ring 510 moves away from the base 535, the sleeve member 570 is raised such that the openings 572 of the sleeve member 575 are brought back into position behind the dogs 575. The dogs 575 are biased radially outward into the openings 572 and into the radially extended position. In the event of a loss of power, the tool 500 is configured to remain in the closed position to prevent inadvertent release of the tubular 225 when supported by the dogs 575.

Figure 15B:
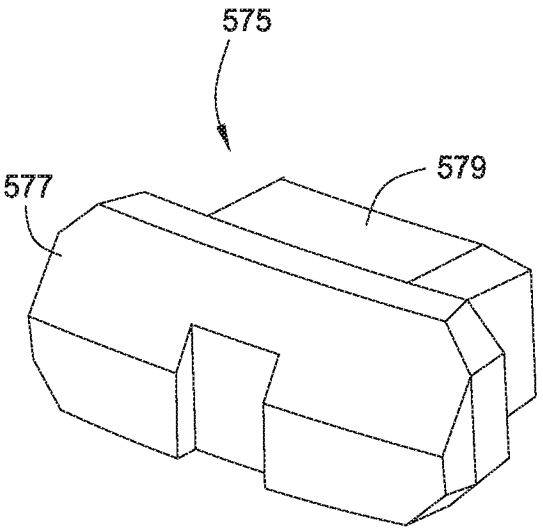
FIGS. 15A and 15B illustrate a dog of the tubular handling tool.
Figure 15A:
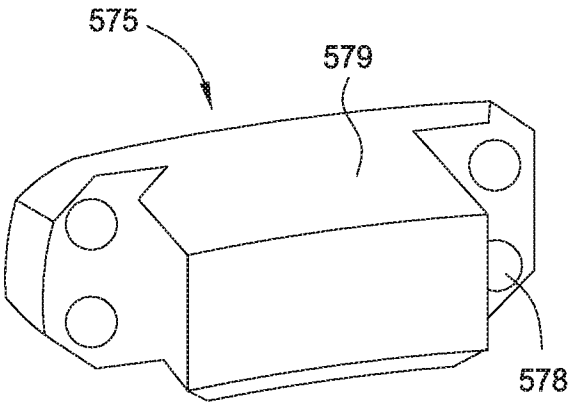

FIGS. 15A and 15B illustrate a dog 575 according to one embodiment. The dog 575 includes the tapered surface 577 that engages the tapered surface 576 of the sleeve member 570 to force the dog 575 radially inward. The dog 575 further includes one or more recesses 578 for supporting one or more biasing members, such as springs, between the base 535 and the dog 575 to bias the dog 575 radially outward. The dog 575 further includes an upper support surface 579 for supporting the tubular 225, such as the bottom side of the flange portion of the tubular 225.

FIGS. 16A, 16B, 17A, and 17B illustrate a tubular handling tool 600, which operates in a similar manner as the tool 500. The embodiments of the tool 600 may be used with the embodiments of the other tools described herein, and vice versa. The components in the tool 600 that are similar to the components in the tool 500 are labeled with the same reference numeral but with a 600 series designation.

The tool 600 includes a support member 610 and a guide member 655, each coupled to a base 635. The guide member 655 may be coupled to the base 635 for guiding and centering the tool 600 onto a tubular, such as a riser string. The tool 600 further includes a sleeve member 670 and actuation members 650 that are configured to rotate the sleeve member 670 relative to the base 635. The sleeve member 670 may be disposed entirely or partially about the circumference of the base 635.

The actuation members 650 are pivotably coupled to the base 635 at one end, and are pivotably coupled to couplers 645 via connection members 620 at the opposite end. The couplers 645 are coupled to the sleeve member 670. When extended and retracted, the actuation members 650 may pivot about the connection member 620 to rotate the sleeve member 670 about the base 635. A guide block 680 may be coupled to the base 635 to guide the travel of the sleeve member 670 about the base 635, and to prevent removal of the sleeve member 670 from the base 635.

The support member 610 may include a solid pipe having an upper shoulder portion for engagement by any conventional elevator known in the art. The support member 610 provides the ability to handle the tool 600 (and thus make up a riser string) using any conventional elevator, such as a drill pipe elevator, which may be supported by a top drive system or other tubular handling system. The support member 610 eliminates the need to completely remove and then replace the conventional (e.g. drill pipe) elevator to make up a riser string and then switch to a drilling operation.

The tool 600 further includes a plurality of dogs 675 that are supported within one or more openings 672 formed in the sleeve member 670 by backing members 673. The dogs 675 are also supported within one or more openings 637 formed in the base 635. The dogs 675 are movable radially inward by the sleeve member 670, and are biased radially outward by one or more biasing members, such as springs, disposed between the base 635 and the dogs 675.

The dogs 675 are movable between a radially retracted (inward) position and a radially extended (outward) position. The dogs 675 are in the radially extended position when the tool 600 is in the open position, and the dogs 675 are in the radially retracted position when the tool 600 is in closed position. The tool 600 may have any number of dogs 675 that are configured to engage a portion of the tubular 225, such as a riser string flange.

Figure 16B:
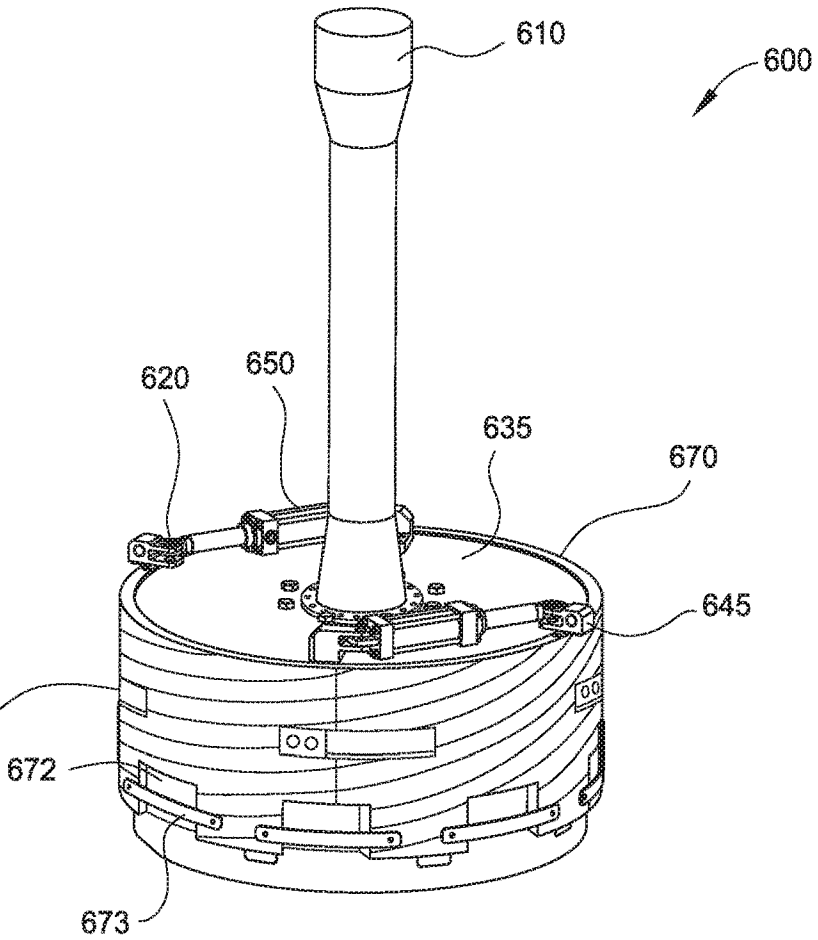
FIGS. 16A, 17A and 16B, 17B illustrate a tubular handling tool in open and closed positions, respectively.
Figure 16A:
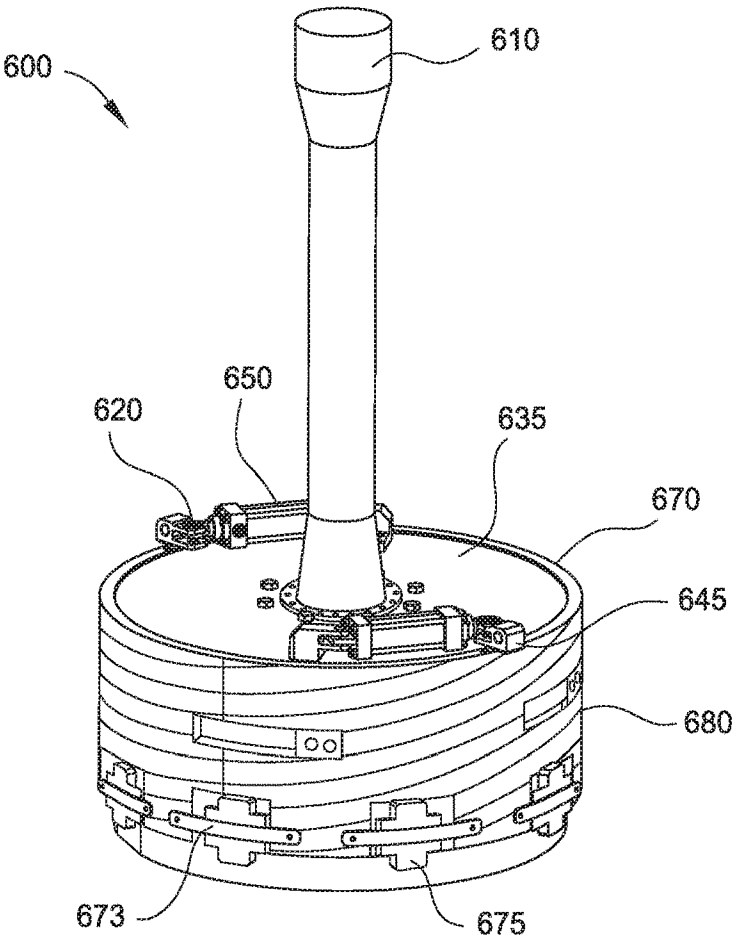
Figure 17B:
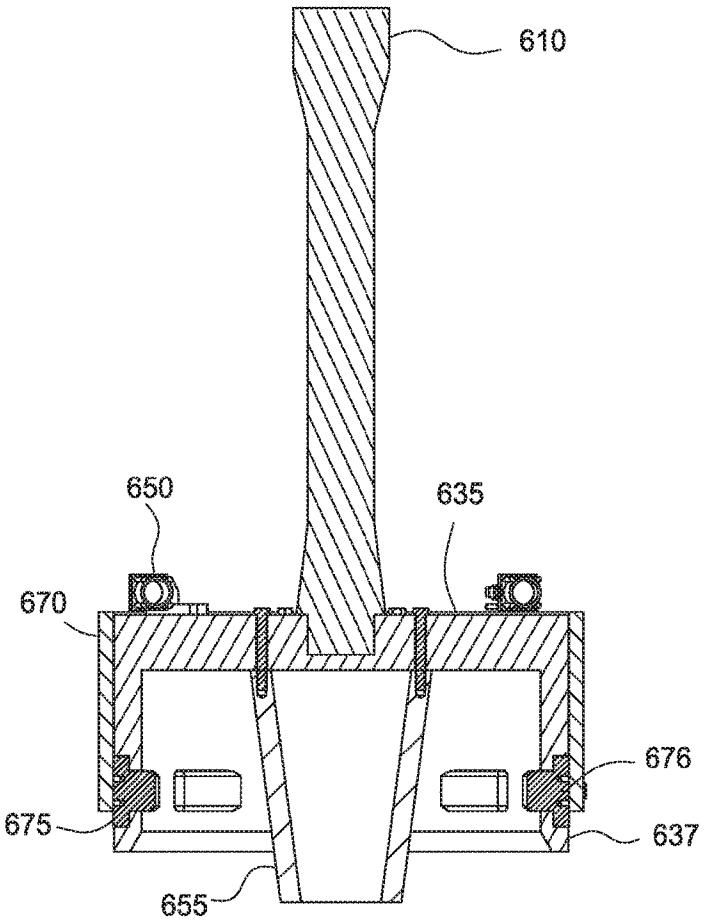
Figure 17A:
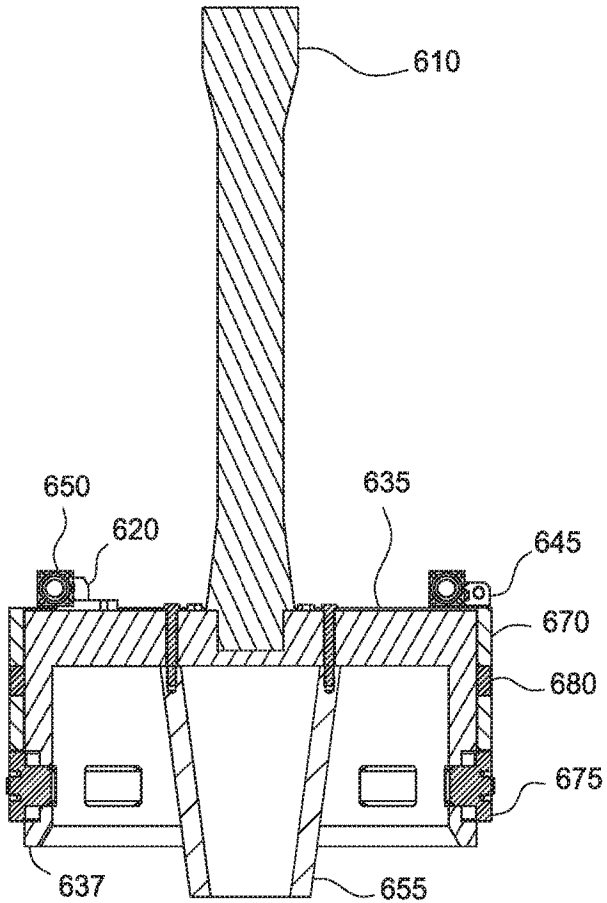

The tool 600 is shown in FIGS. 16A and 17A in the open position, and is shown in FIGS. 16B and 17B in the closed position. When in the open position, the actuation members 650 are in the retracted position, and the dogs 675 are biased in the radially extended (outward) position. To move the tool 600 to the closed position, the actuation members 650 are moved to the extended position, which rotates the sleeve member 670 about the base 635 in one direction, such as a clockwise direction. As the sleeve member 670 rotates relative to the base 635, a tapered surface 676 of the sleeve member 670 moves into engagement with a tapered surface 677 of the dogs 675 to force the dogs 675 radially inward into the retracted position. The openings 672 of the sleeve member 670 are moved adjacent to the dogs 675, such that the inner surface of the sleeve member 670 maintains the dogs 675 in the radially retracted (inward) position.

To move the tool 600 back to the open position, the actuation member 650 is moved to the retracted position, which rotates the sleeve member 670 about the base 635 in an opposite direction, such as a counterclockwise direction. The sleeve member 670 is moved such that the openings 672 of the sleeve member 675 are brought back into position behind the dogs 675. The dogs 675 are biased radially outward into the openings 672 and into the radially extended position.

Figure 18B:
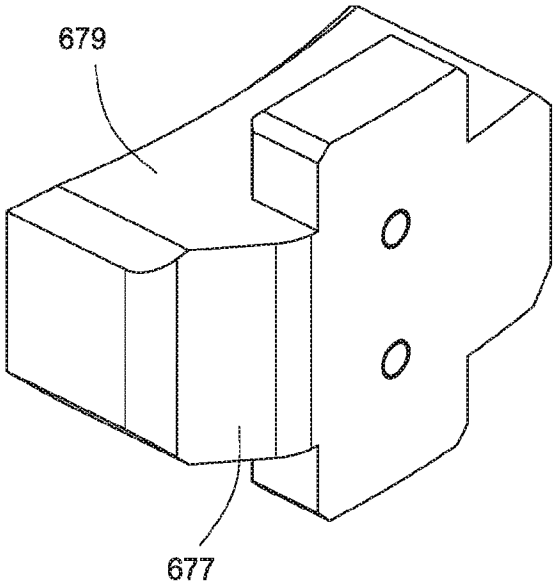
FIGS. 18A and 18B illustrate a dog of the tubular handling tool.
Figure 18A:
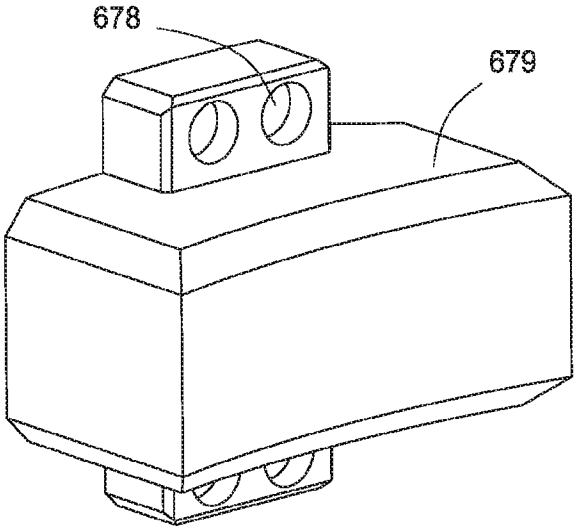

FIGS. 18A and 18B illustrate a dog 675 according to one embodiment. The dog 675 includes the tapered surface 677 that engages the tapered surface 676 of the sleeve member 670 to force the dog 675 radially inward. The dog 675 further includes one or more recesses 678 for supporting one or more biasing members, such as springs, between the base 635 and the dog 675 to bias the dog 675 radially outward. The dog 675 further includes an upper support surface 679 for supporting the tubular 225, such as the bottom side of the flange portion of the tubular 225.

In one embodiment, the sleeve member 670 may include an angled slot (such as slot 115), and the dogs 675 may include a connection member (such as connection member 120) that is movable within the angled slot. Rotation of the sleeve member 670 in one direction may force the connection member along the angled slot to move the dogs 675 radially inward into engagement with the tubular 225. Rotation of the sleeve member 670 in the opposite direction may force the connection member back along the angled slot to move the dogs 675 radially outward away from engagement with the tubular 225.

Figure 19B:
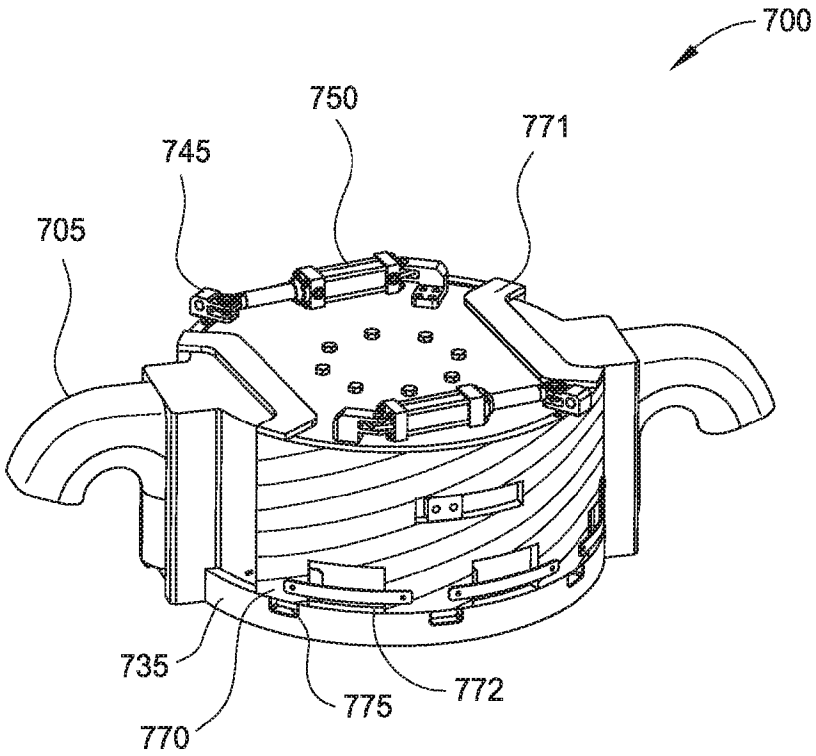
FIGS. 19A, 20A and 19B, 20B illustrate a tubular handling tool in open and closed positions, respectively.
Figure 19A:
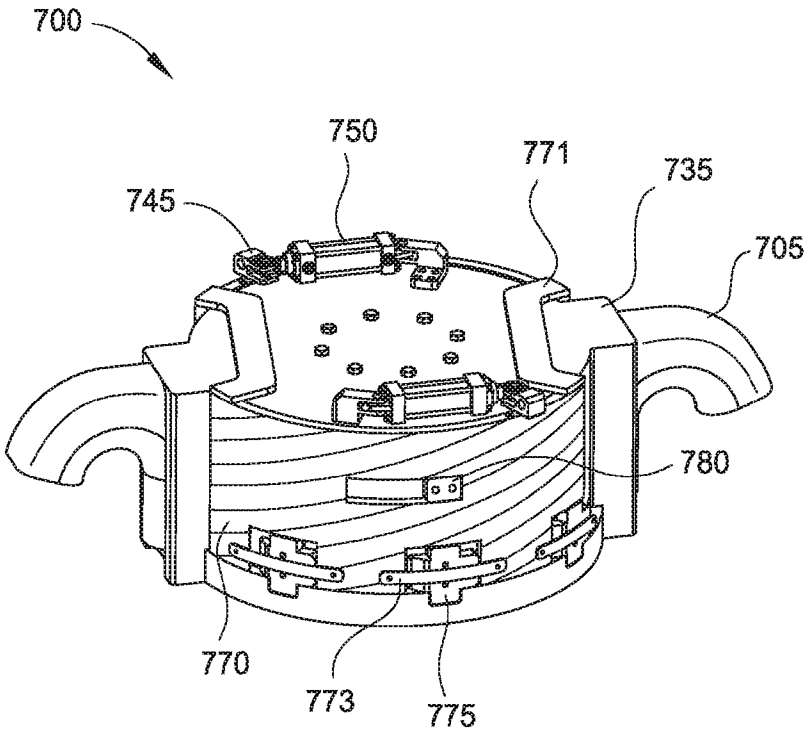
Figure 20B:
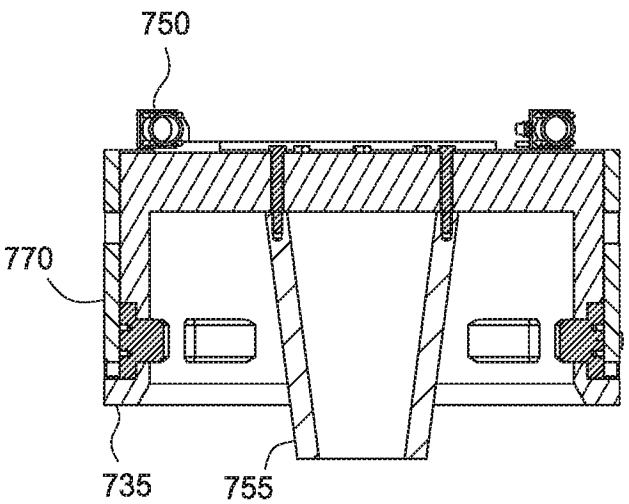
Figure 20A:
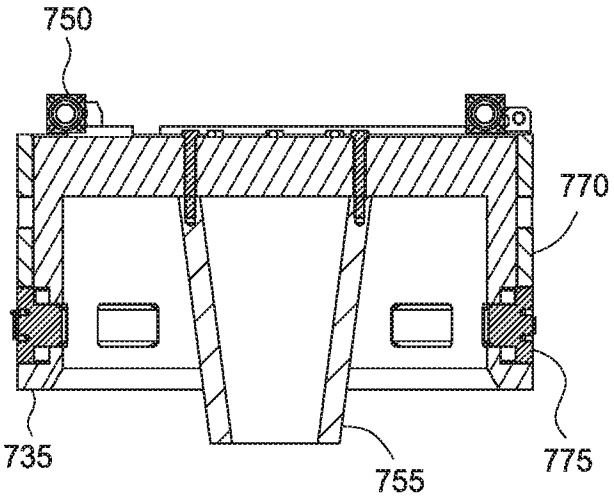

FIGS. 19A, 19B, 20A, and 20B illustrate a tubular handling tool 700, which operates in a similar manner as the tool 600. The tool 700 is shown in FIGS. 19A and 20A in the open position, and is shown in FIGS. 19B and 20B in the closed position. The embodiments of the tool 700 may be used with the embodiments of the other tools described herein, and vice versa. The components in the tool 700 that are similar to the components in the tool 600 are labeled with the same reference numeral but with a 700 series designation.

The components of the tool 700 that are similar to the tool 600 include a base 735, openings 737 in the base 735, a guide member 755, actuation members 750, couplers 745, dogs 775, backing members 773, a sleeve member 770, and openings 772 in the sleeve member 770. A full description of these components will not be repeated herein for brevity. A difference between the tool 700 and the tool 600 is a pair of ears 705 coupled to the base 735 to support the tool 700 instead of the support member 610. Another difference is the sleeve member 770 being formed from two partially circular sections that are coupled together using connection members 771 to accommodate for the ears 705 being coupled to the outer circumference of the base 735.

Figure 21A:
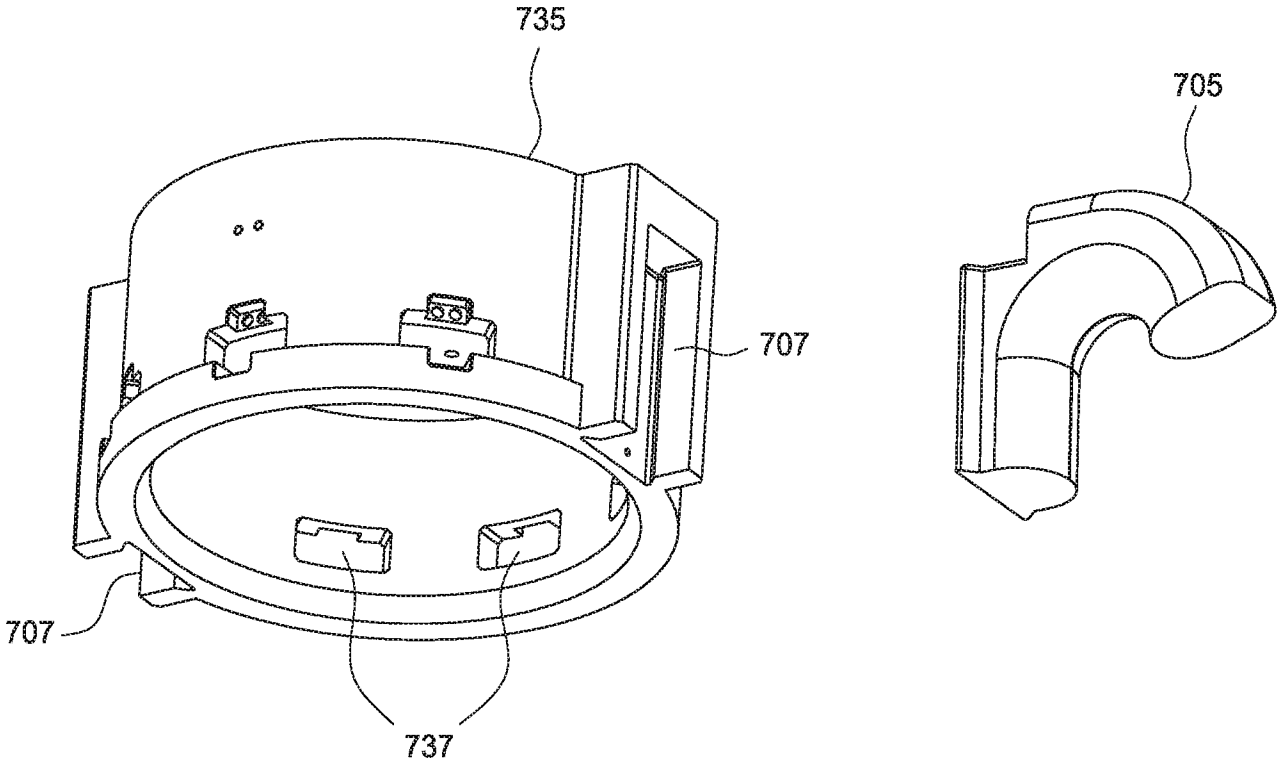
FIG. 21A illustrates a base and an ear of the tubular handling tool.

FIG. 21A illustrates the base 735 having slots 707, such as dovetail grooves as known in the art, formed on opposite sides of the base 735. The ears 705 may be inserted into the slots 707 to couple the ears 705 to the base 735. The ears 705 may be configured to attach the tool 700 to a top drive system or other tubular handling system, such as by bails. Different sizes of ears 705 can be easily connected to and removed from the slots 707 of the base 735 to accommodate for different sizes of bails.

Figure 22:
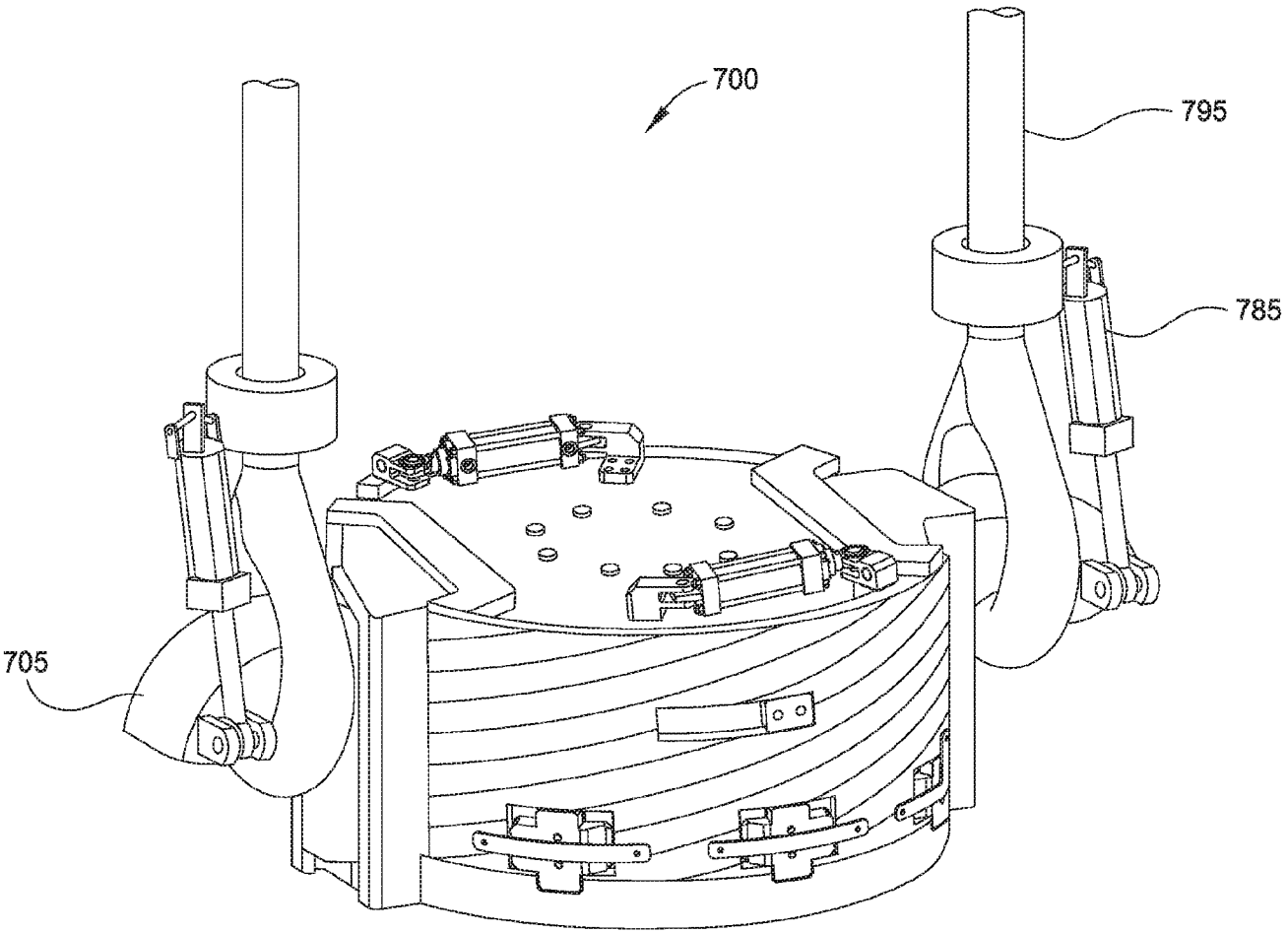
FIG. 22 illustrates a rotary actuator of the tubular handling tool.

FIG. 22 illustrates the tool 700 supported by bails 795 that may be coupled to a top drive system or other tubular handling system. The bails 795 are coupled to the ears 705 of the tool 700. Also illustrated are rotary actuators 785, such as piston/cylinders, configured to rotate and tilt the tool 700 from the substantially vertical position. The rotary actuators 785 may be coupled to the bails 795 at one end, and may be coupled to the ears 705 at the opposite end. The ability to tilt the tool 700 is useful when using the tool 700 to pick up a tubular that is positioned at an angle, such as when positioned at a V-door as known in the art.

Figure 23B:
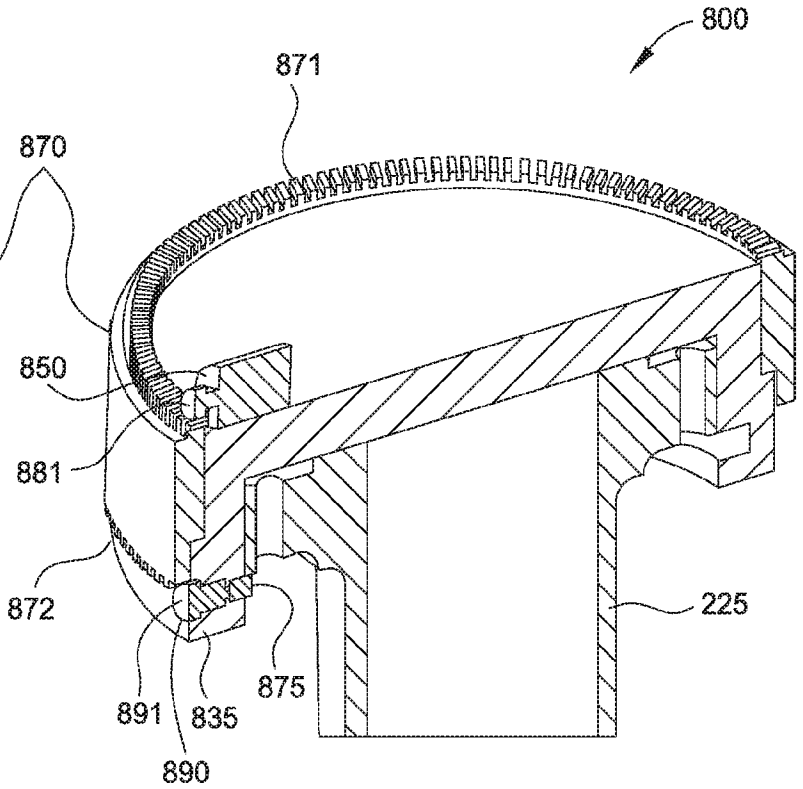
FIGS. 23A, 23B, 23C, and 23D illustrate a tubular handling tool.
Figure 23A:
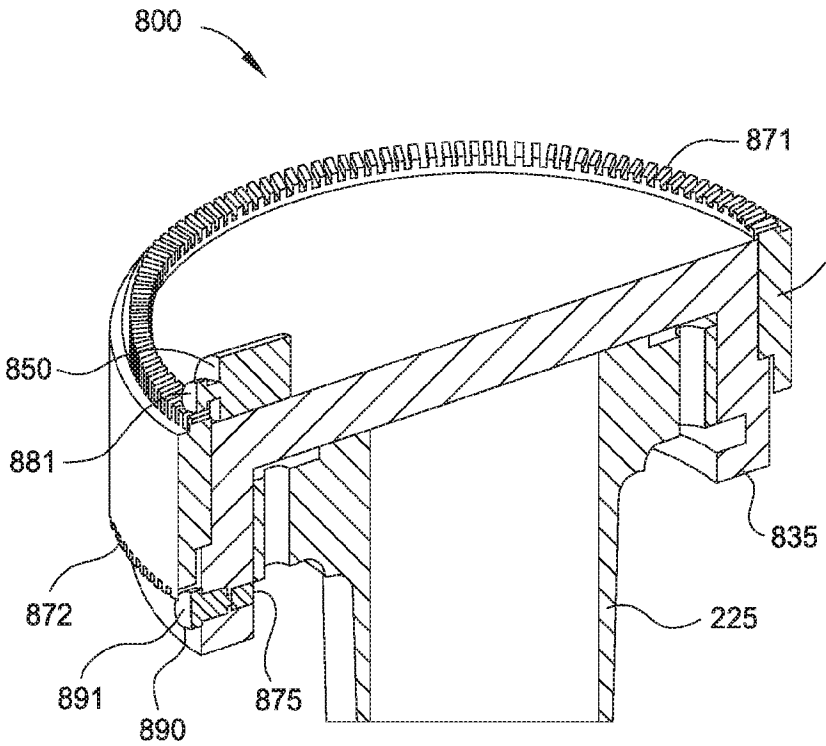
Figure 23D:
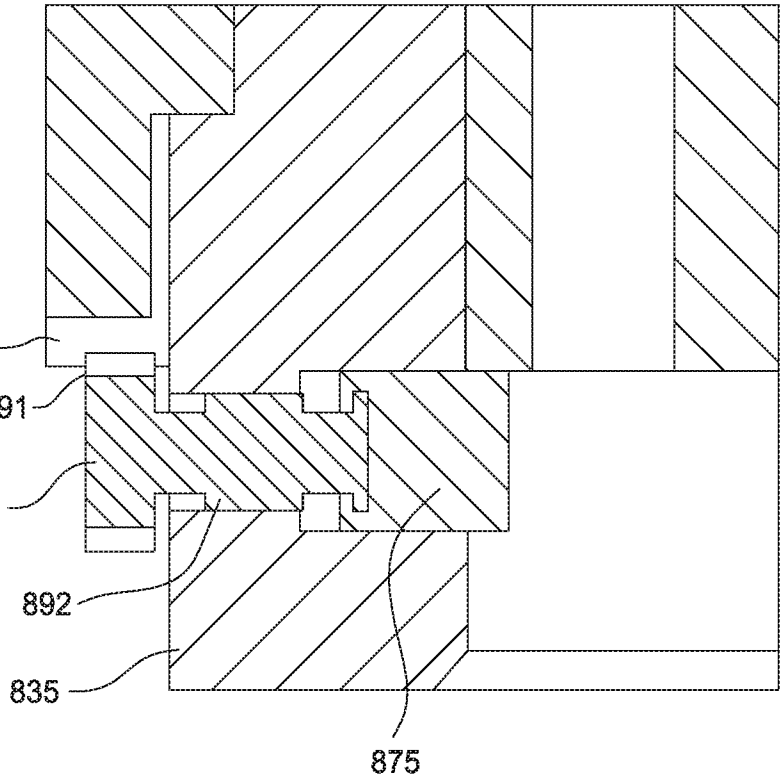
Figure 23C:
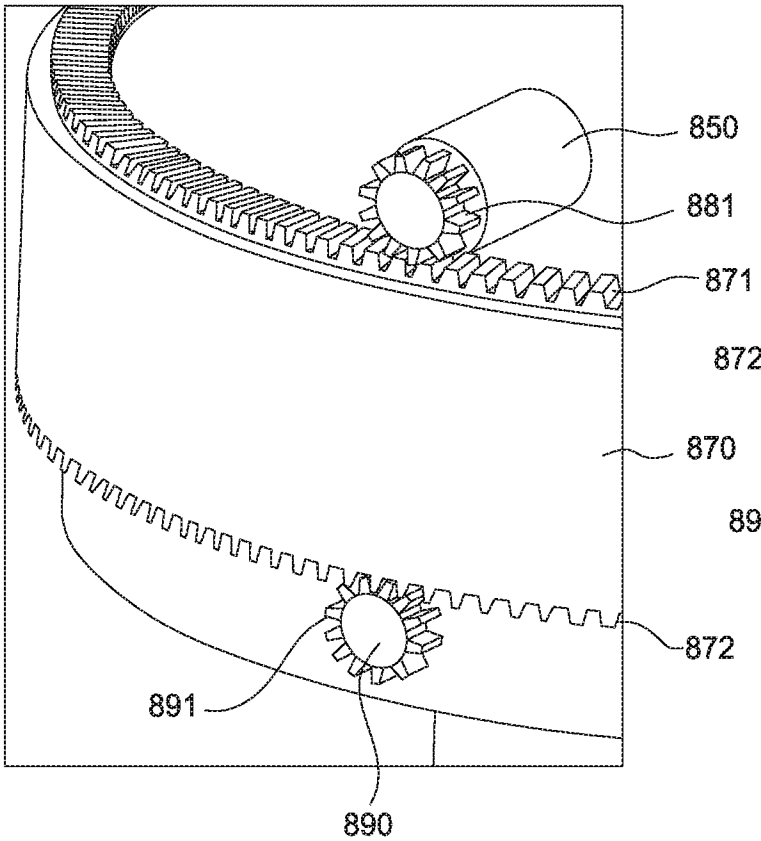

FIGS. 23A, 23B, 23C, and 23D illustrate a tubular handling tool 800, which operates in a similar manner as the tools 600, 700. The tool 800 is shown in FIG. 23A in the open position, and is shown in FIGS. 23B and 23D in the closed position. The embodiments of the tool 800 may be used with the embodiments of the other tools described herein, and vice versa. The components in the tool 800 that are similar to the components in the tools 600, 700 are labeled with the same reference numeral but with an 800 series designation.

The tool 800 has a sleeve member 870 that rotates about a base 835 to move one or more dogs 875 radially inward into a closed position to support the tubular member 225. The sleeve member 870 includes an upper gear track 871 disposed on top of the sleeve member 870, and a lower gear track 872 disposed on the bottom of the sleeve member 870. One or more actuation members 850, such as a motor, is coupled to the base 835 and includes a pinion 881 in engagement with the upper gear track 871 of the sleeve member 870. The actuation member 850 may rotate the sleeve member 870 about the circumference of the base 835.

The lower gear track 872 of the sleeve member 870 engages a pinion 891 of a drive member 890. The drive member 890 is coupled to the base 835 by a threaded engagement 892. Rotation of the sleeve member 870 (by the actuation member 850) rotates the pinion 891 and thus the drive member 890. Rotation of the drive member 890 moves the drive member 890 through the threaded engagement 892 to move the dogs 875 radially inward into engagement with the tubular 225. The drive member 890 may be coupled to the dogs 875 such that rotation of the sleeve member 870 in the clockwise and counterclockwise directions radially pushes and pulls the dogs 875 radially inward and outward. In one embodiment, the drive member 890 may be configured to move the dogs 875 in one radial direction, while one or more biasing members, such as springs, may be used to move the dogs 875 in the opposite radial direction.

Figure 24B:
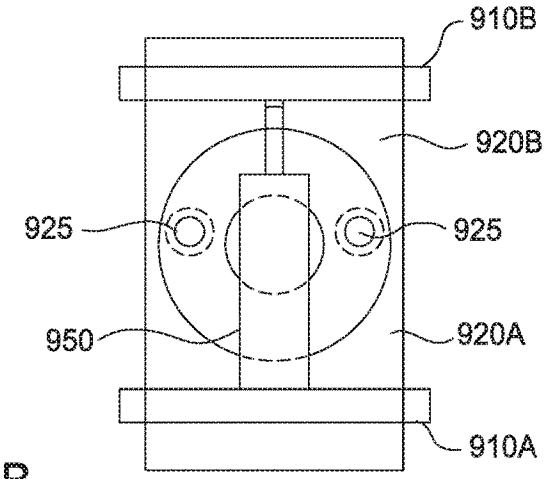
FIGS. 24A, 24B, 24C, and 24D illustrate a tubular handling tool.
Figure 24D:
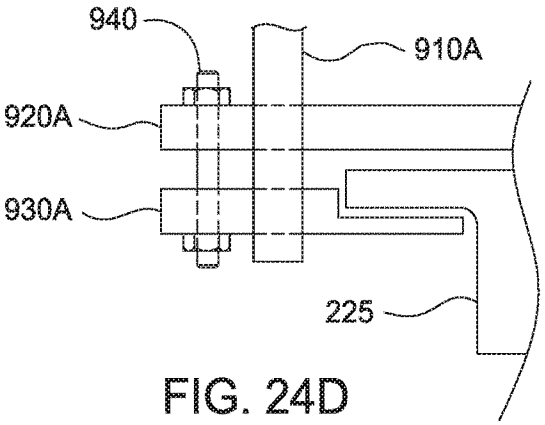
Figure 24A:
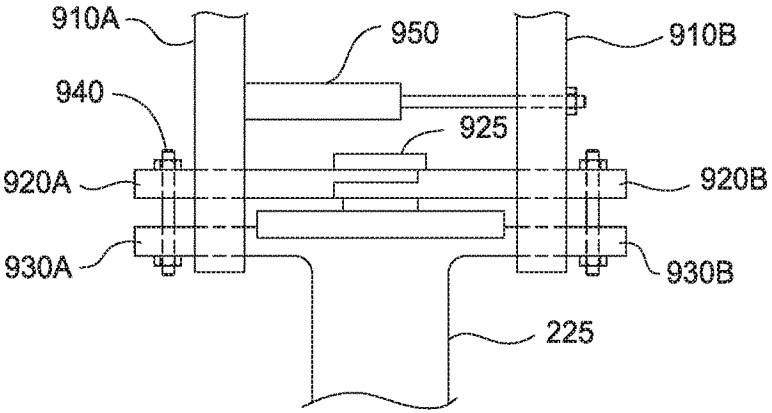
Figure 24C:
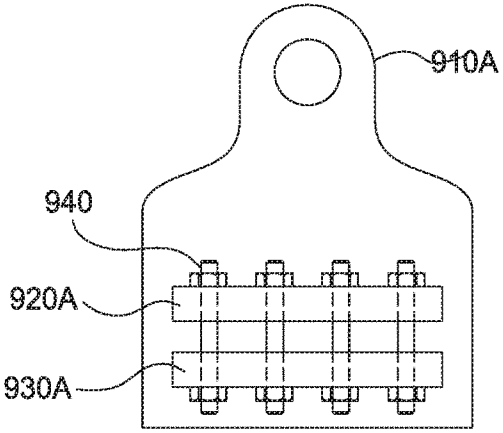

FIGS. 24A, 24B, 24C, and 24D illustrate a tubular handling tool 900. The tool 900 is shown in FIGS. 24A and 24B in the closed position. The embodiments of the tool 900 may be used with the embodiments of the other tools described herein, and vice versa.

The tool 900 includes support members 910A, 910B for supporting upper plate members 920A, 920B and lower plate members 930A, 930B. The tool 900 may be supported by bails via the eyelets in the support members 910A, 910B. The plate members 920A, 930A may be coupled together by connection members 940, such as bolts. The plate members 920A, 930A may be disposed through slots formed in the support member 910A, and may be spaced apart such that the flange of the tubular 225 may be positioned between the upper plate member 920A and the lower plate member 930A. The plate members 920B, 930B and the support member 910B may be arranged in a similar manner.

An actuation member 950, such as a piston/cylinder, may be coupled at opposite ends to the support members 910A, 910B. The actuation member 950 may pull and push the support members 910A, 910B and thus the plate members 920A, 930A and 920B, 930B toward and away from each other. To engage the flange of the tubular 225, the actuation member 950 may move to an extended position to move the support members 910A, 910B away from each other a sufficient distance to position the flange of the tubular 225 between the lower plate members 930A, 930B. When in position, the actuation member 950 may move to a retracted position to draw the support members 910A, 910B toward each other, such that the lower plate members 930A, 930B engage the bottom side of the flange of the tubular 225. The upper plate members 920A, 920B also may be drawn into engagement with each other above the flange of the tubular 225, such that connection members 925 may be inserted through aligned openings in the upper plate members 920A, 920B to secure the tool 900 in the closed position.

Figure 25:
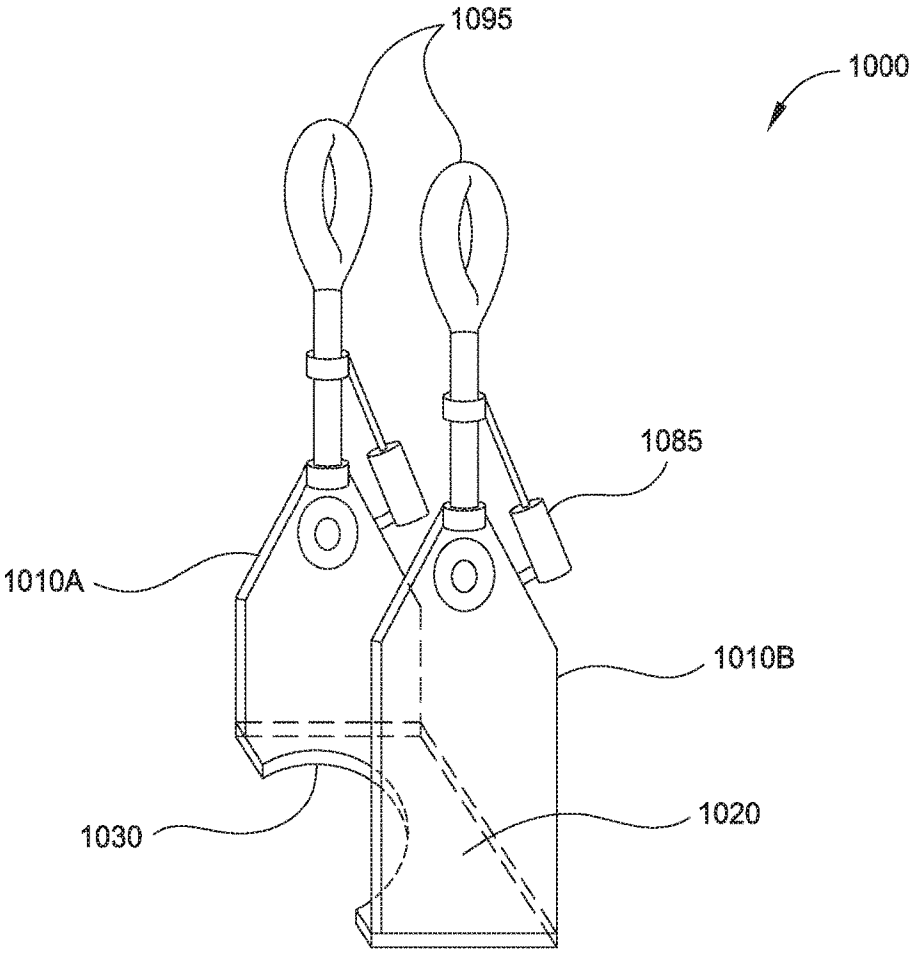
FIG. 25 illustrates a tubular handling tool.

FIG. 25 illustrates a tubular handling tool 1000. The embodiments of the tool 1000 may be used with the embodiments of the other tools described herein, and vice versa. The tool 1000 includes bails 1095 coupled to support members 1010A, 1010B, and a base 1020 that is disposed between the support members 1010A, 1010B. The base 1020 includes a partial opening 1030 into which the tubular 225 may be laterally inserted. The flange of the tubular 225 may be supported on top of the base 1020. One or more rotary actuators 1085 may be coupled at one end to the bails 1095, and may be coupled at the opposite end to the support members 1010A, 1010B. The rotary actuators 1085 may rotate and tilt the support members 1010A, 1010B and thus the base 1020 into and out of engagement with the flange of the tubular 225.

FIGS. 26A, 26B, 26C, and 26D illustrate a tubular handling tool 1100, which operates in a similar manner as the tools 600, 700. The tool 1100 is shown in FIG. 27A in the open position, and is shown in FIG. 27B in the closed position. The embodiments of the tool 1100 may be used with the embodiments of the other tools described herein, and vice versa. The components in the tool 1100 that are similar to the components in the tools 600, 700 are labeled with the same reference numeral but with an 1100 series designation.

The components of the tool 1100 that are similar to the tools 600, 700 include ears 1105, a base 1135, openings 1137 in the base 1135, a guide member 1155, actuation members 1150, couplers 1145, dogs 1175, a sleeve member 1170, and a guide block 1180. A full description of these components will not be repeated herein for brevity. A difference between the tool 1100 and the tools 600, 700 is the sleeve member 1170 having one or more support members 1171 disposed about the circumference of the sleeve member 1170. The support members 1171 may be coupled to or formed integral with the sleeve member 1170. Each support member 1171 includes an angled slot 1115 formed along its length. The dogs 1175 are connected to the support members 1171 by a connection member 1120, such as a pin, that is movable within the slot 1115 to move the dogs 1175 radially inward and outward relative to the base 1135.

Figure 26A:
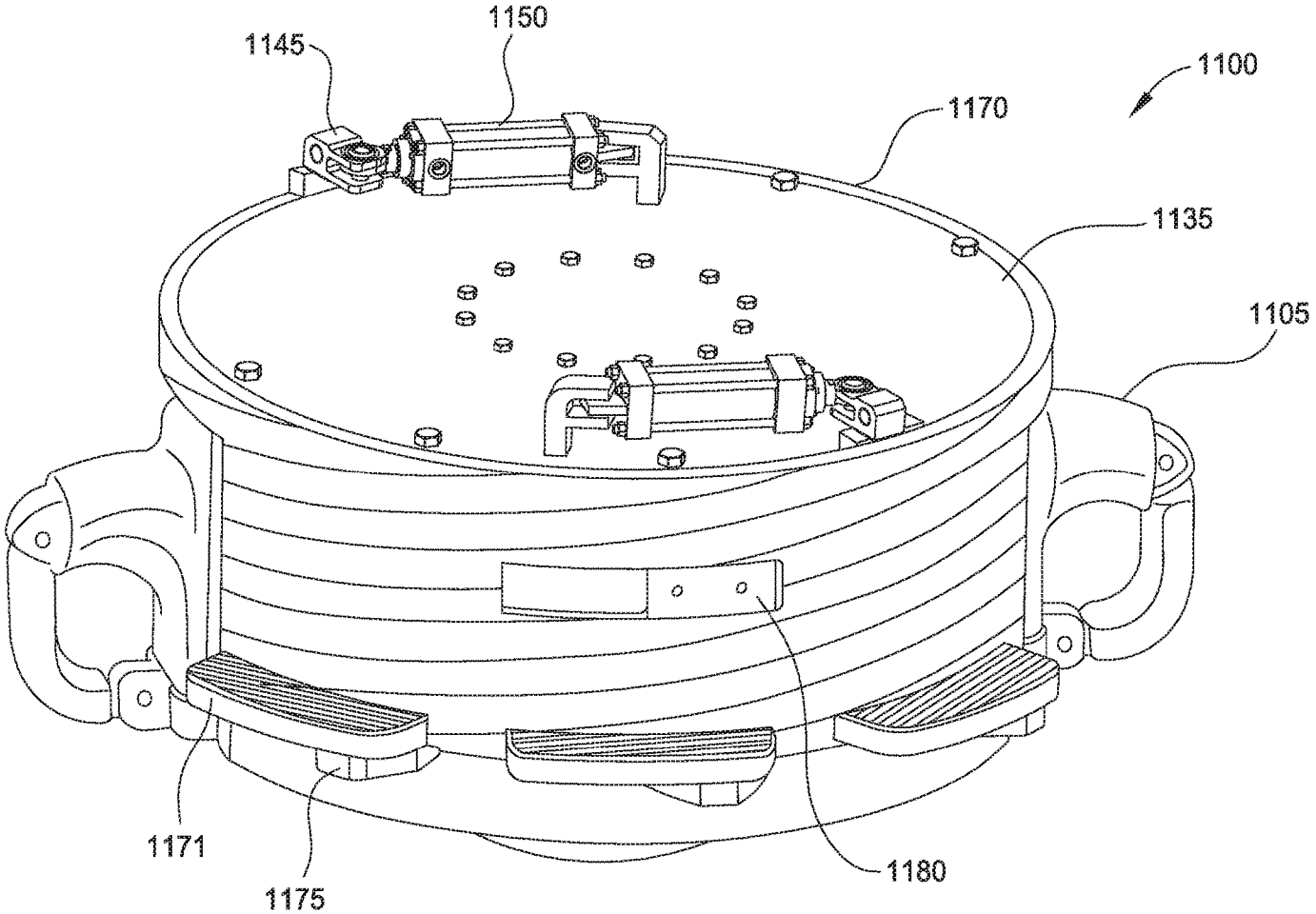
FIGS. 26A, 26B, 26C, and 26D illustrate a tubular handling tool.
Figure 26B:
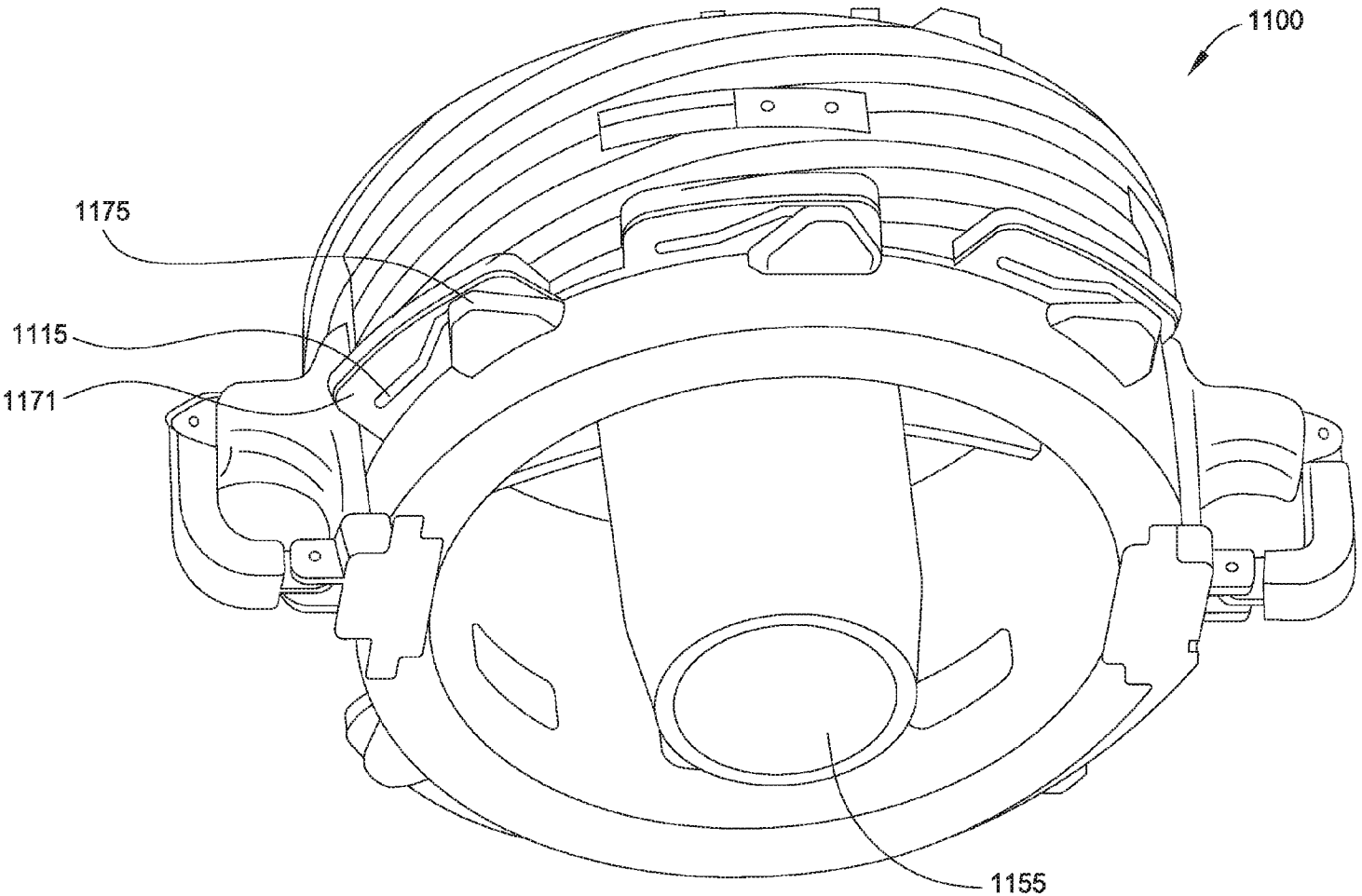
Figure 26C:
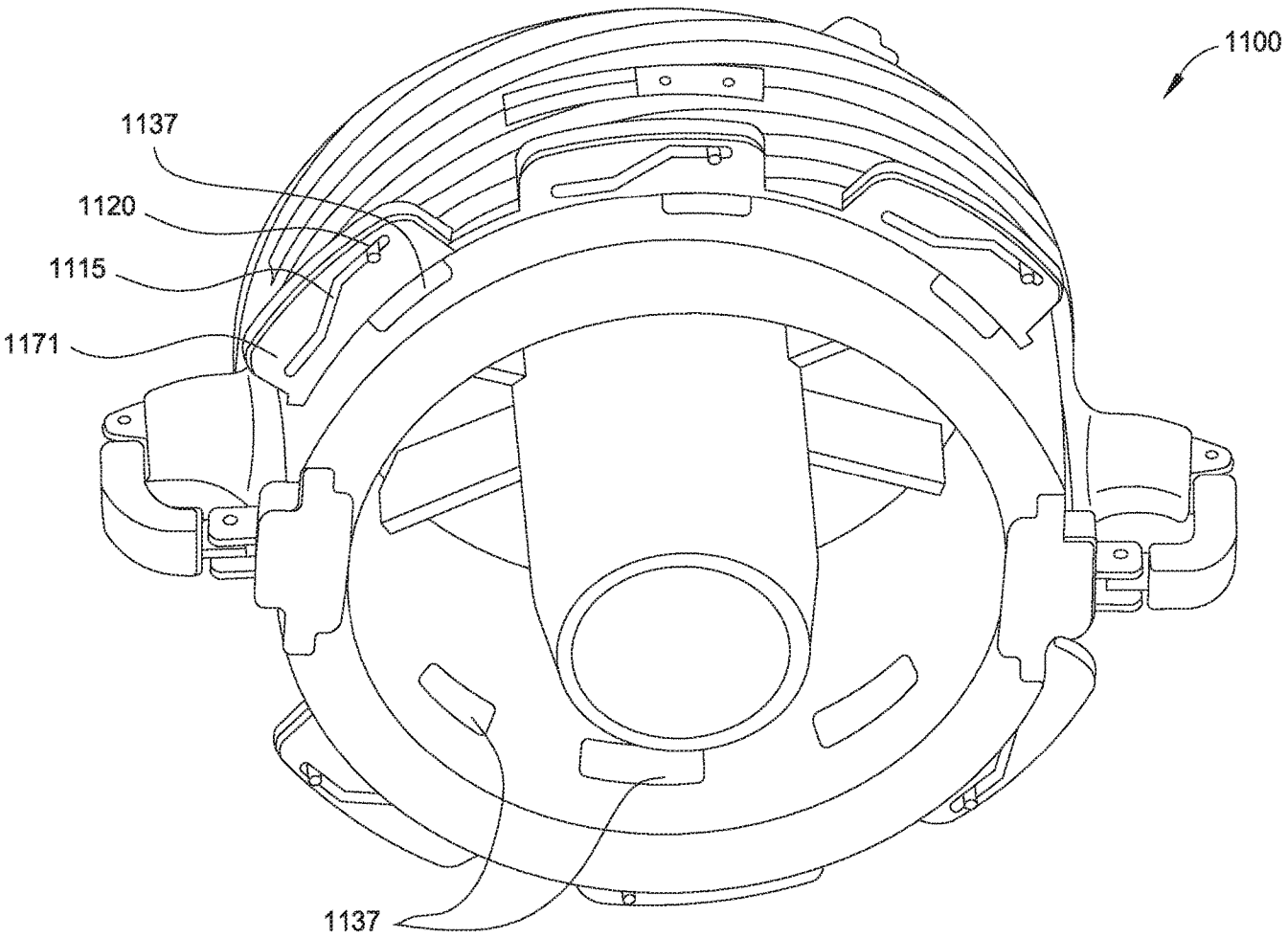
Figure 26D:
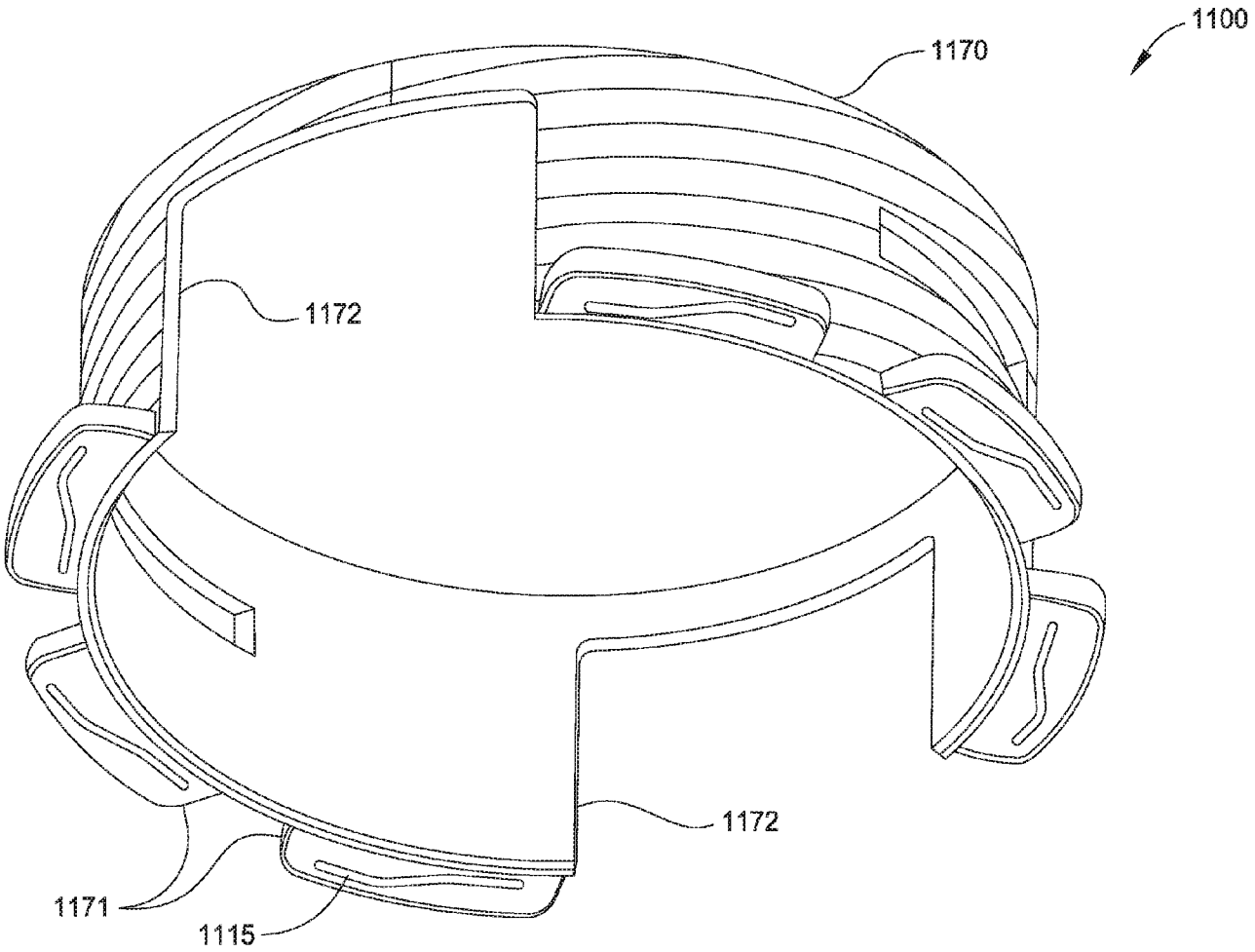
Figure 27B:
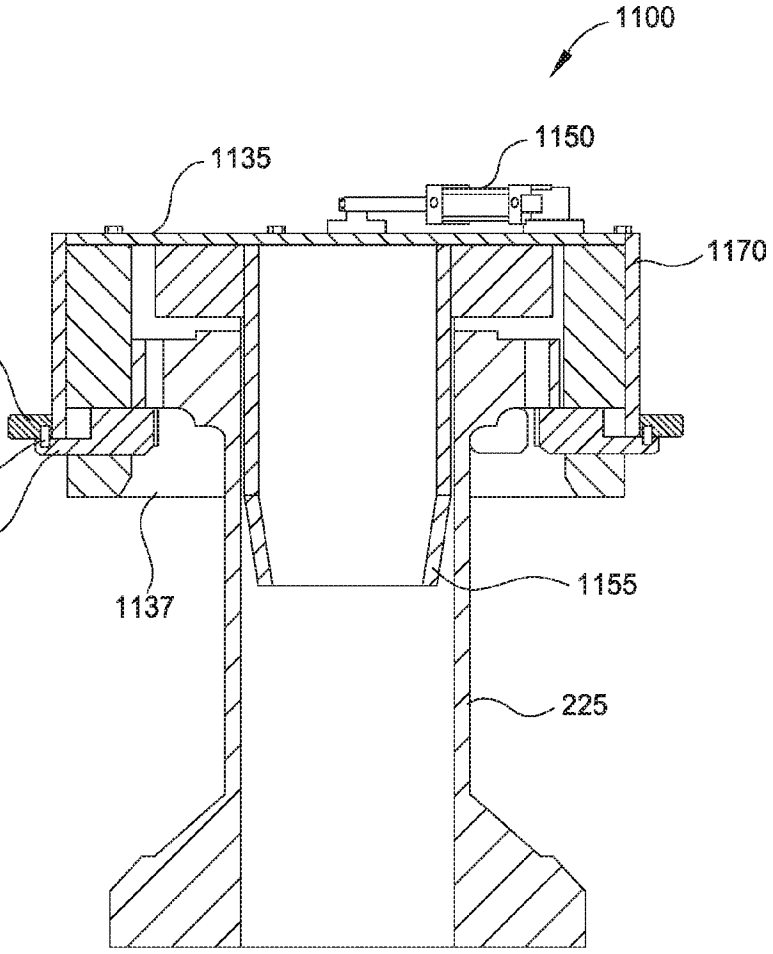
FIGS. 27A and 27B illustrate the tubular handling tool in open and closed positions, respectively.
Figure 27A:
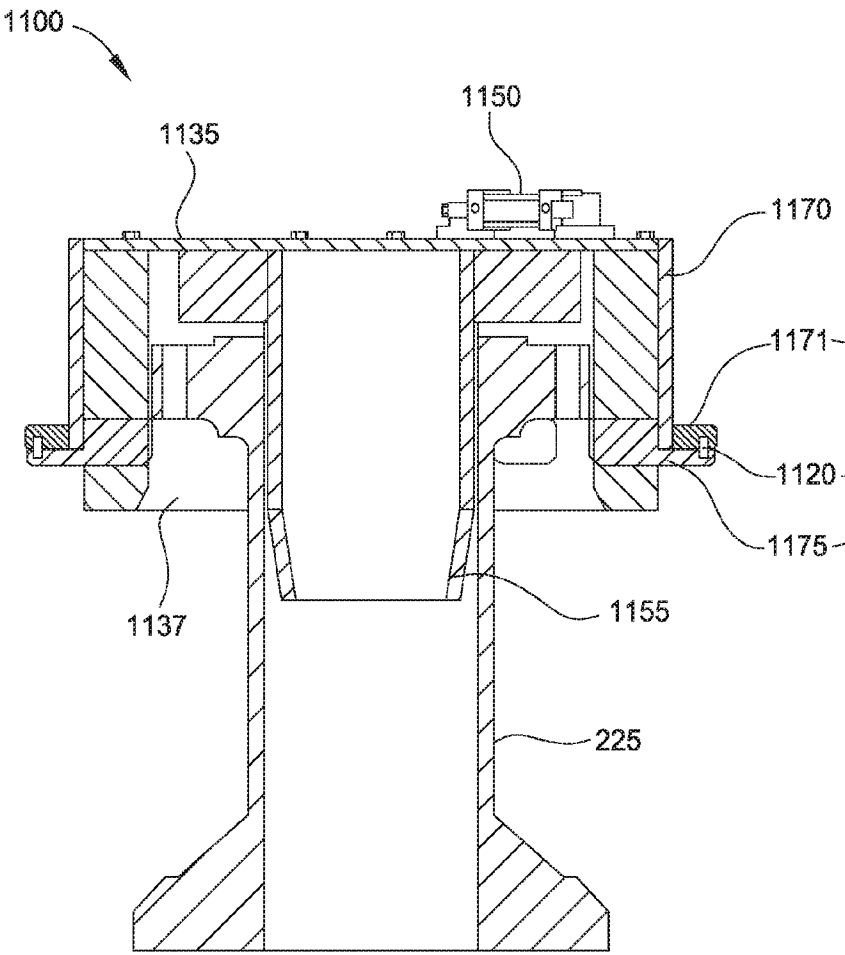

In FIG. 26C, the dogs 1175 are not shown to more clearly illustrate the openings 1137 formed in the base 1135; the slots 1115 formed in the support members 1171; and the connection members 1120 disposed in the slots 1115. In FIG. 26D, the sleeve member 1170 is illustrated having a pair of recesses 1172 formed on opposite sides, within which the ears 1105 are positioned when coupled to the base 1135. Also illustrated are the support members 1171 (and slots 1115) disposed at the bottom edge of the sleeve member 1170.

Rotation of the sleeve member 1170 in one direction (via retraction or extension of the actuation members 1150) moves the support members 1171 about the base 1135 and laterally relative to the dogs 1175. The support members 1171 move the connection members 1120 along the angled slots 1115 to move the dogs 1175 radially inward into engagement with the tubular 225. The dogs 1175 are supported by and move radially within the openings 1137 of the base 1135. Rotation of the sleeve member 1170 in the opposite direction (via retraction or extension of the actuation members 1150) moves the support members 1171 about the base 1135 and laterally relative to the dogs 1175. The support member 1171 moves the connection member 1120 back along the angled slot 1115 to move the dogs 1175 radially outward away from engagement with the tubular 225.

Figure 28:
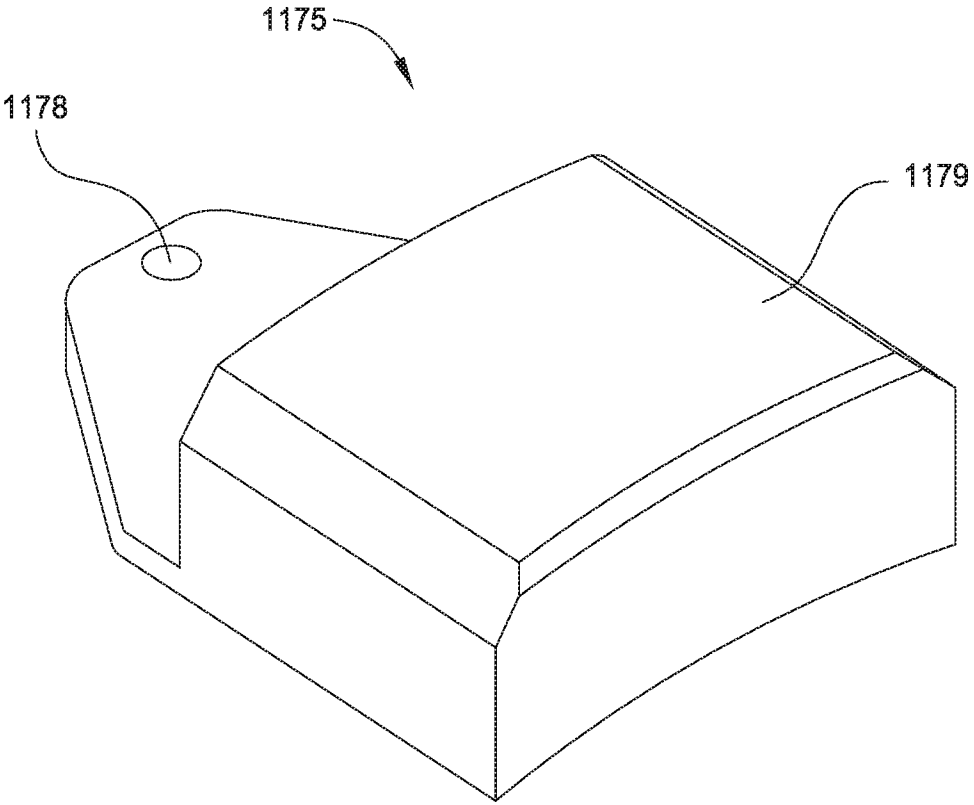
FIG. 28 illustrates a dog of the tubular handling tool.

FIG. 28 illustrates a dog 1175 according to one embodiment. The dog 1175 includes one or more recesses 1178 for supporting the connection member 1120, such as pins, between the dog 1175 and the support member 1171. The dog 1175 further includes an upper support surface 1179 for supporting the tubular 225, such as the bottom side of the flange portion of the tubular 225.

In one embodiment, a tool for use with a tubular comprises a base, a ring member, an actuation member configured to move the ring member relative to the base, and a clamp member rotationally attached to the base. The clamp member is configured to move between a radially retracted position and a radially extended position as the ring member moves relative to the base. The clamp member is coupled to the ring member by a pin that is movable within a slot formed in a coupling member. The pin is movable within the slot to move the clamp member between the radially retracted position and the radially extended position. The slot includes a substantially vertical section and a substantially angled section.

The clamp member is pivotally coupled to the base by a pin disposed through a support member that is coupled to the base. The ring member engages an end of the clamp member to move the clamp member between the radially retracted position and the radially extended position.

In one embodiment, a method of gripping a tubular comprises positioning a tool adjacent the tubular, the tool having a base, a ring member and a clamp member; moving the ring member relative to the base; and gripping the tubular by moving the clamp member into engagement with the tubular as a result of the movement of the ring member relative to the base.

The method further comprises moving the clamp member between a radially retracted position and a radially extended position as the ring member moves relative to the base. The clamp member is coupled to the ring member by a pin that is movable within a slot formed in a coupling member. The method further comprises moving the pin within the slot to move the clamp member between the radially retracted position and the radially extended position. The slot includes a substantially vertical section and a substantially angled section.

In one embodiment, a tool for use with a tubular comprises a base, a sleeve member, an actuation member configured to move the sleeve member relative to the base, and a dog member coupled to the base. The dog member is configured to move between a radially retracted position and a radially extended position as the sleeve member moves relative to the base. The sleeve member may be raised and lowered relative to the base by the actuation member to move the dog member between the radially extended position and the radially retracted position. The sleeve member may be rotated relative to the base by the actuation member to move the dog member between the radially retracted position and the radially extended position.

The dog member is disposed in an opening formed in the base. The dog member is movable into an opening formed in the sleeve member to the radially extended position. The dog member is moveable out of the opening formed in the sleeve member to the radially retracted position.

The sleeve member includes a support member coupled to or integral with the sleeve member, the support member having an angled slot formed therein. The dog member is coupled to the support member by a connection member that is movable within the angled slot. Rotation of the sleeve member relative to the base in one direction moves the connection member along the angled slot to move the dog member to the radially retracted position. Rotation of the sleeve member relative to the base in an opposite direction moves the connection member along the angled slot to move the dog member to the radially extended position. The actuation member engages a gear track of the sleeve member to rotate the sleeve member relative to the base. A drive member engages another gear track of the sleeve member to move the dog member between the radially extended position and the radially retracted position.

In one embodiment, a tool for use with a tubular comprises a pair of arms pivotably connected to each other, a pair of clamp members pivotably connected to the pair of arms, and an actuation member configured to force ends of the arms away from each other to move the pair of clamp members from a radially retracted position to a radially extended position.

In one embodiment, a tool for use with a tubular comprises a pair of support members, a pair of upper plate members coupled to the support members, a pair of lower plate members coupled to the support members, and an actuation member configured to force the support members toward and away from each other to move the pair of upper plate members into and out of engagement with each other, and to move the pair of lower plate members into and out of engagement with the tubular.

While the foregoing is directed to embodiments of the invention, other and further embodiments of the invention may be devised without departing from the basic scope thereof, and the scope thereof is determined by the claims that follow.

The invention claimed is:

1. A tool for use with a tubular, the tool comprising:

a base;

a ring member having a coupling member;

an actuation member configured to move the ring member relative to the base; and a clamp member rotationally attached to the base, wherein the clamp member is configured to move between a radially retracted position and a radially extended position as the ring member moves relative to the base, and wherein the clamp member is coupled to the ring member when in the radially retracted and extended positions, and wherein the clamp member is coupled to the ring member by a pin that is movable within a slot formed in the coupling member.

2. The tool of claim 1, wherein the pin is movable within the slot to move the clamp member between the radially retracted position and the radially extended position.

3. The tool of claim 2, wherein the slot includes a substantially angled section.

4. The tool of claim 3, wherein the slot further includes a substantially vertical section.

5. The tool of claim 1, wherein the clamp member is pivotally coupled to the base by another pin disposed through a support member that is coupled to the base.

6. The tool of claim 1, wherein the ring member engages an end of the clamp member to move the clamp member between the radially retracted position and the radially extended position.

7. The tool of claim 1, further comprising a pair of ears coupled to the base from which the tool is suspended.

8. The tool of claim 1, wherein the actuation member comprises a hydraulically or pneumatically actuated cylinder.

9. The tool of claim 1, wherein when the actuation member moves the ring member away from the base, the clamp member is moved to the radially extended position.

10. The tool of claim 1, wherein when the actuation member moves the ring member toward the base, the clamp member is moved to the radially retracted position.

11. A method of gripping a tubular, the method comprising:

positioning a tool adjacent the tubular, the tool having a base, a ring member and a clamp member;

moving the ring member relative to the base;

gripping the tubular by moving the clamp member into engagement with the tubular as a result of the movement of the ring member relative to the base, wherein the clamp member is coupled to the ring member when moved into engagement with the tubular; and moving the clamp member between a radially retracted position and a radially extended position as the ring member moves relative to the base, wherein the clamp member is coupled to the ring member by a pin that is movable within a slot formed in a coupling member.

12. The method of claim 11, further comprising moving the pin within the slot to move the clamp member between the radially retracted position and the radially extended position.

13. The method of claim 12, wherein the slot includes a substantially angled section.

14. The method of claim 13, wherein the slot further includes a substantially vertical section.

15. The method of claim 11, wherein the clamp member is pivotally coupled to the base by another pin disposed through a support member that is coupled to the base.

16. The method of claim 11, wherein the ring member engages an end of the clamp member to move the clamp member between the radially retracted position and the radially extended position.

17. The method of claim 11, further comprising a pair of ears coupled to the base from which the tool is suspended.

18. The method of claim 11, wherein the actuation member comprises a hydraulically or pneumatically actuated cylinder.

19. The method of claim 11, wherein when the actuation member moves the ring member away from the base, the clamp member is moved to the radially extended position to release the tubular.

20. The method of claim 11, wherein when the actuation member moves the ring member toward the base, the clamp member is moved to the radially retracted position to grip the tubular.

* * * * *